United States Patent [19]

Ohashi et al.

[11] 4,042,425

[45] Aug. 16, 1977

[54] PROCESS OF PRETREATING COLD-ROLLED STEEL SHEET FOR ANNEALING

[75] Inventors: Nobuo Ohashi; Motoyuki Konishi; Minoru Nishida; Yukio Inokuchi, all of Chiba, Japan

[73] Assignee: Kawasaki Steel Corporation, Kobe, Japan

[21] Appl. No.: 578,937

[22] Filed: May 19, 1975

Related U.S. Application Data

[62] Division of Ser. No. 295,721, Oct. 6, 1972, abandoned.

[30] Foreign Application Priority Data

| | | |
|---|---|---|
| Oct. 11, 1971 | Japan | 46-79432 |
| Oct. 23, 1971 | Japan | 46-83664 |
| Oct. 23, 1971 | Japan | 46-83665 |
| Nov. 5, 1971 | Japan | 46-87551 |

[51] Int. Cl.[2] ..... C21D 1/44; C22B 35/00; C25D 5/50

[52] U.S. Cl. ..... 148/13.1; 75/123 A; 148/6.24; 148/14; 148/31.5; 148/122; 204/37 R

[58] Field of Search ..... 148/13.1, 31, 31.5, 148/113, 122, 6.24; 75/123 A; 204/37 R

[56] References Cited

U.S. PATENT DOCUMENTS

| | | | |
|---|---|---|---|
| 2,828,233 | 3/1958 | Langworthy | 148/122 |
| 3,054,732 | 9/1962 | McQuade | 204/37 |
| 3,180,767 | 4/1965 | Easton et al. | 148/122 |
| 3,653,979 | 4/1972 | Whitton et al. | 148/6.24 |
| 3,700,506 | 10/1972 | Tanaka et al. | 148/113 |

*Primary Examiner*—Walter R. Satterfield
*Attorney, Agent, or Firm*—Fleit & Jacobson

[57] ABSTRACT

A pretreatment of cold-rolled steel sheet for annealing so as to suppress graphite formation on the surface thereof and nitrogenization during the annealing for recrystallization, by causing an effective amount of sulfur, aluminum, tin, arsenic, lead, antimony, bismuth, selenium, and/or tellurium to exist on the steel sheet surface.

15 Claims, 9 Drawing Figures

PROCESS OF PRETREATING COLD-ROLLED STEEL SHEET FOR ANNEALING

This is a divisional application of U.S. Ser. No. 295,721, filed Oct. 6, 1972 and now abandoned.

This invention relates to a pretreating process of cold-rolled steel sheet for annealing, and more particularly to a process for pretreating cold-rolled steel sheet for annealing so as to prevent graphite formation on steel sheet surfaces and nitrogenization in the course of the annealing.

For finishing into a final product, recrystallization annealing is applied to ordinary cold-rolled low-carbon steel sheet or steel strip (the word "sheet" referring to both sheet and strip, hereinafter), usually in the tightly coiled condition in a non-oxidizing atmosphere, either immediately after cold-rolling hot-rolling plate (or strip) or after degreasing the cold-rolled steel sheet. There has been a great change in recent years in details of such finishing process for the cold-rolled low-carbon steel sheet, due to the evolution of various new techniques in this field, for instance, steel making with large-scale LD-converter, and numerous developments in pickling liquid, rolling mill lubricant, and annealing atmosphere.

Recently, it has been noticed that the recrystallization annealing often tends to blacken the surfaces of the cold-rolled low-carbon steel sheet, and thereby greatly degrading the appearance of the steel sheet, and that the recrystallization annealing tends to cause nitrogenization (nitrogen pick up) from atmosphere during annealing, which may deteriorate the physical properties of the steel sheet.

The surface blackening is a newly found phenomenon which is determined to surface condition of steel sheet, and the following tendencies and nature of the surface blackening are known at the present.

1. Cold-rolled low-carbon steel sheet which is made from the top portion of an ingot is more susceptible to the surface blackening.

2. Tightly coiled steel sheet is more susceptible to the surface blackening during the recrystallization annealing than open-coil steel sheet.

3. Judging from the crystal structure determined by X-ray diffraction and electron diffraction, the black substance causing the surface blackening is graphite.

4. For temperatures below the $A_1$ transformation point of steel sheet, the chance of causing the surface blackening increases as the annealing temperature becomes higher.

5. Surface blackening can occur even when carbon is present neither on the surfaces of the cold-rolled steel sheet nor in the atmosphere surrounding the steel sheet.

Sooting (edge carbon or snaky edge) is a conventionally known phenomenon which soils steel sheet surfaces, as in the case of the aforesaid surface blackening. The sooting is caused when an atmospheric gas containing carbon monoxide, e.g., DX gas, is used, because the carbon monoxide gas is decomposed during the annealing and precipitates carbon on the steel sheet surfaces as soot. The sooting is also caused by residual rolling mill lubricant on the steel sheet surfaces, because the rolling mill lubricant decomposes during the annealing and amorphous carbon precipitates on the steel sheet surfaces as soot. The following tendencies and nature of the sooting have been known.

1. Sooting occurs only at the edge portions of steel sheet, taken in the width direction thereof.

2. Judging from the crystal structure, the carbon deposited on the steel surfaces as soot is amorphous carbon.

3. The chance of the sooting is the highest at annealing temperature in the vicinity of 550° C.

Thus, the sooting is likely to occur in the course of heating and cooling during the recrystallization annealing.

Thus, the sooting is different from the aforesaid surface blackening caused by graphite formation on the steel sheet surfaces.

With modern process for making cold-rolled steel sheet, the edge carbon is almost completely eliminated, by thoroughly removing residual rolling mill lubricant from the steel sheet surfaces prior to annealing by employing a highly efficient degreasing process, and by minimizing or completely removing the carbon monoxide in atmospheric gas by diluting AX gas with nitrogen gas or by using atmospheric gas consisting of HNX gas. Even under these conditions which eliminate the edge carbon, the aforesaid surface blackening occurs rather frequently, so that the graphite formation on the surfaces of cold-rolled low-carbon steel sheet causing the surface blackening is a quite new phenomenon.

The inventors have carried out studies on the graphite formation on the surfaces of cold-rolled low-carbon steel sheet. For instance, a test was made in which cold-rolled low-carbon sheets were chemically polished to completely remove the rolling mill lubricant and were tightly overlaid one on the other, so as to carry out the recrystallization annealing in vacuo or in an atmosphere free from carbon monoxide gas, such as a hydrogen-nitrogen atmosphere or a pure nitrogen atmosphere. As a result of the test, it was found that the graphite formation of the steel sheet surfaces takes place during the annealing even if the surfaces and the surrounding atmosphere are completely free from carbon, and the amount of the carbon formed on the steel sheet surfaces is in agreement with the amount of carbon which is lost from the inside of such steel sheets. Thus, the source of the carbon of the graphite formed on the steel sheet surfaces is the carbon contained in the low-carbon steel sheet itself.

This phenomenon occurs more easily when the gap between adjacent steel sheets is small, so that recrystallization annealing of tightly wound coil, as practised for the most of actual cold-rolled low-carbon steel sheets, faces a serious problem.

On the other hand, conventional open coil annealing, which has been used for decarburization and denitrogenation (nitrogen-removal), does not cause the graphite formation so frequently. In order to carry out the open coil annealing, however, it is necessary to uncoil a tightly wound coil into an open coil before the annealing, and upon completion of the desired annealing, the open coil must be coiled again into the initial tightly wound coil. Such repeated recoiling is time-consuming. Accordingly, the time-consuming open coil annealing results in a low productivity and causes a cost increase. In short, it is not practical to switch the conventional recrystallization annealing of cold-rolled low-carbon steel sheet to the open coil process.

The recrystallization annealing is usually effected in a non-oxidizing atmosphere. Typical examples of the gas for such non-oxidizing atmosphere are as follows:

HNX gas; 5 to 10% by volume of hydrogen and the balance of nitrogen.

AX gas; 75 by volume of hydrogen and the balance of nitrogen.

DX gas; 9 to 10% by volume of carbon monoxide, 5 to 6% of carbon dioxide, 10 to 12% of hydrogen, and the balance of nitrogen.

Thus, most of the conventional atmospheric gases for the recrystallization annealing contain nitrogen.

When the cold-rolled low-carbon steel sheet is heated in such a nitrogen-containing atmosphere, the nitrogen concentration in the steel sheet in solid solution varies, so that the solid solution nitrogen concentration balances with the gaseous nitrogen partial pressure in the atmosphere. Thus, nitrogenization or denitrogenation of (or nitrogen-removal from) the steel sheet takes place. The amount of nitrogen in solid solution in the steel sheet, which balances with the gas phase nitrogen, varies depending on the nitrogen partial pressure in the surrounding atmosphere and the annealing temperature. A typical value of the solid solution nitrogen in steel at 700° C under 1 atm pressure of gaseous nitrogen is about 0.002% by weight.

Thus, if the steel does not contain any element which easily forms a nitride, such as aluminum, titanium, niobium, vanadium, zirconium, silicon, and boron, as in the case of ordinary rimmed steel, and if such steel sheet has a nitrogen concentration of about 0.002% by weight, there will be no significant nitrogenization of the steel sheet from the nitrogen-containing atmosphere during the recrystallization annealing. On the other hand, if the steel sheet contains an element or elements capable of easily forming nitride or nitrides, such as aluminum, titanium, niobium, vanadium, zirconium, silicon, and boron, and if the solid solution nitrogen concentration in the steel sheet is lower than that balancing with the partial pressure of gaseous nitrogen in the atmosphere, the recrystallization annealing will cause nitrogenization of the steel sheet to such an extent that the solid solution nitrogen immediately forms nitride or nitrides with the element or elements, and after completing the formation of the nitride or nitrides, the solid solution nitrogen concentration in the steel sheet increases until it balances with the gaseous nitrogen partial pressure in the atmosphere.

As a result, the total nitrogen concentration in the steel sheet increases excessively, so that the physical properties of the final product, especially its elongation, ageing, and magnetic properties, are deteriorated.

Conventional rimmed steel contains nitrogen in excess of 0.002% by weight in the ingot state, so that the aforesaid nitrogenization of the steel sheet by the recrystallization annealing has not been any serious problem with such conventional rimmed steel. Recent innovation of steel making techniques, such as an improved of oxygen purity, or vacuum degassing, however, has succeeded in cutting down the nitrogen concentration in the steel to a level of below 0.002% by weight, or even below 0.0015% by weight.

When the nitrogen concentration in the cold-rolled rimmed steel, as rolled, is below a level balancing with the gaseous nitrogen partial pressure in the annealing atmosphere, even if the steel sheet is made of low-nitrogen rimmed steel containing no element or elements capable of easily forming a nitride or nitrides, such as aluminum, titanium, niobium vanadium, zirconium, silicon, and boron, the nitrogenization of the steel sheet occurs in the course of the recrystallization annealing, which nullifies the preceding efforts of reducing the nitrogen concentration in the course of making steel. Thus, the physical properties of the final product, such as the elongation, ageing, and magnetic properties, are deteriorated.

Moreover, the nitrogenization during the recrystallization annealing does not necessarily occur uniformly over the entire span of the steel sheet surface, and unevenness of the nitrogenization is inevitable to a certain extent. When the steel sheet is subjected to press or other work, the uneven nitrogenization results in an uneven deformation of the steel sheet surfaces, so that undesirable undulations may be caused.

Thus, the nitrogenization of steel during the recrystallization annealing is a very serious problem for the manufacture of cold-roll low-carbon steel sheet containing one or more elements capable of easily forming one or more nitrides, such as aluminum, titanium, niobium, vanadium, zirconium, silicon, and boron, for the manufacture of the cold-rolled low-carbon rimmed steel sheet and the silicon steel sheet. It is now well recognized that the prevention of the nitrogenization during the recrystallization annealing is essential for achieving good physical properties of the final product and for eliminating uneven deformation of the steel sheet worked.

As regards the nitrogenization phenomenon during the recrystallization annealing, the inventors have found out the following properties and tendencies as a result of their studies and experiments.

1. The nitrogenization phenomenon frequently occurs in the recrystallization annealing in the tightly wound steel strip condition, and the chance of its occurrence increases as the gap between adjacent sheets becomes smaller.

2. Chance of the nitrogenization phenomenon is small in annealing open coil steel strip.

3. The nitrogenization phenomenon tends to occur more frequently at the central portion in the width direction of the steel sheet than at the edge or ear portion of the steel sheet.

4. When the aforesaid DX gas atmosphere is used for recrystallization annealing of cold-rolled steel sheet, the chance of the nitrogenization phenonemon is comparatively small, but the snake edge or edge carbon phenomenon takes place while cooling the steel sheet from the annealing temperature, in which soot (amorphous carbon) is deposited in the vicinity of the ear portions of the steel sheet. The use of an atmosphere containing nitrogen and hydrogen, such as the HNX gas or the AX gas, is liable to an increased risk of the nitrogenization phenomenon.

Although the risk of the nitrogenization may be reduced by annealing steel sheet in the open coil condition, it is not practicable to effect the recrystallization annealing in this method for all the cold-rolled steel sheet due to the aforesaid disadvantage.

Thus, there is a need for a new process which prevents both the graphite formation on steel sheet surfaces and the nitrogenization without necessitating any drastic changes in the existing process for making cold-rolled low-carbon steel sheet.

Therefore, an object of the present invention is to meet the aforesaid need by providing an improved process, based on their findings that both the graphite formation and the nitrogenization can be prevented by inactivating the steel sheet surfaces by causing an effective amount of inactivating element or elements, such as sulfur, aluminum, tin, arsenic, lead, antimony, bismuth, selenium, and/or tellurium, to exist on the steel sheet surfaces, because the graphite formation and the nitrogenization are a kind of surface reactions which take place on the steel surfaces.

Another object of the present invention is to provide a process in which the aforesaid element or elements are adsorbed onto the steel sheet surfaces, by suitably applying, e.g., by electrolytically depositing, one or more compounds containing the element or elements on the steel sheet surfaces.

A further object of the present invention is to provide a process which can provide a lustrous, clear, cold-rolled, low-carbon sheet steel with an extremely thin layer without discoloration.

To specifically prevent the nitrogenization of the steel sheet during the recrystallization annealing, one or more alloying elements, such as, tin, arsenic, lead, antimony, bismuth, selenium, and/or tellurium, may be added in the cold-rolled low-carbon steel sheet.

To effectively apply the aforesaid element or elements on the steel sheet surfaces, an aqueous solution or a suspension containing at least one element selected from the group consisting of sulfur, aluminum, tin, arsenic, lead, antimony, bismuth, selenium, and tellurium is uniformly spread on the steel sheet surfaces, so as to achieve a uniform coverage at a density of not smaller than $2g/m^2$, and then steel sheet is subjected to the recrystallization annealing.

For a better understanding of the invention, reference is made to the accompanying drawing, in which.

Figure 5:
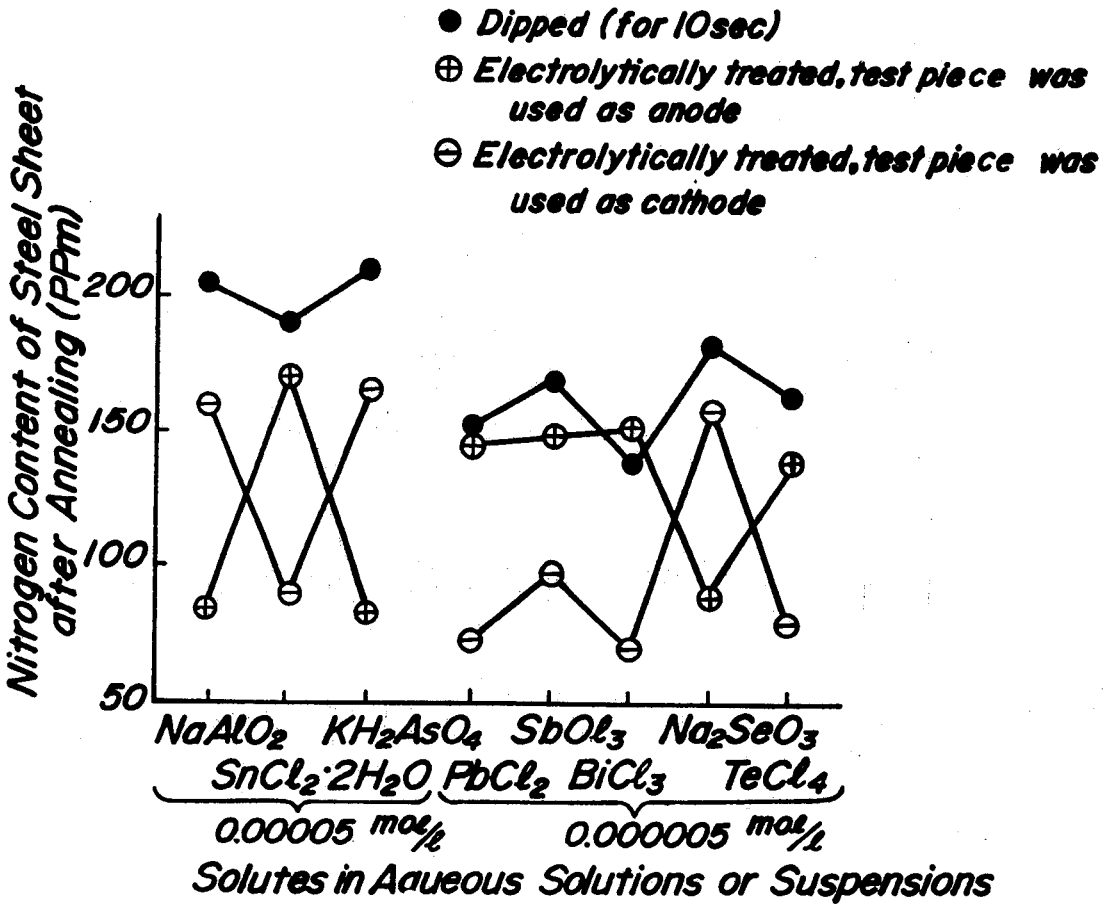
Figure 6:
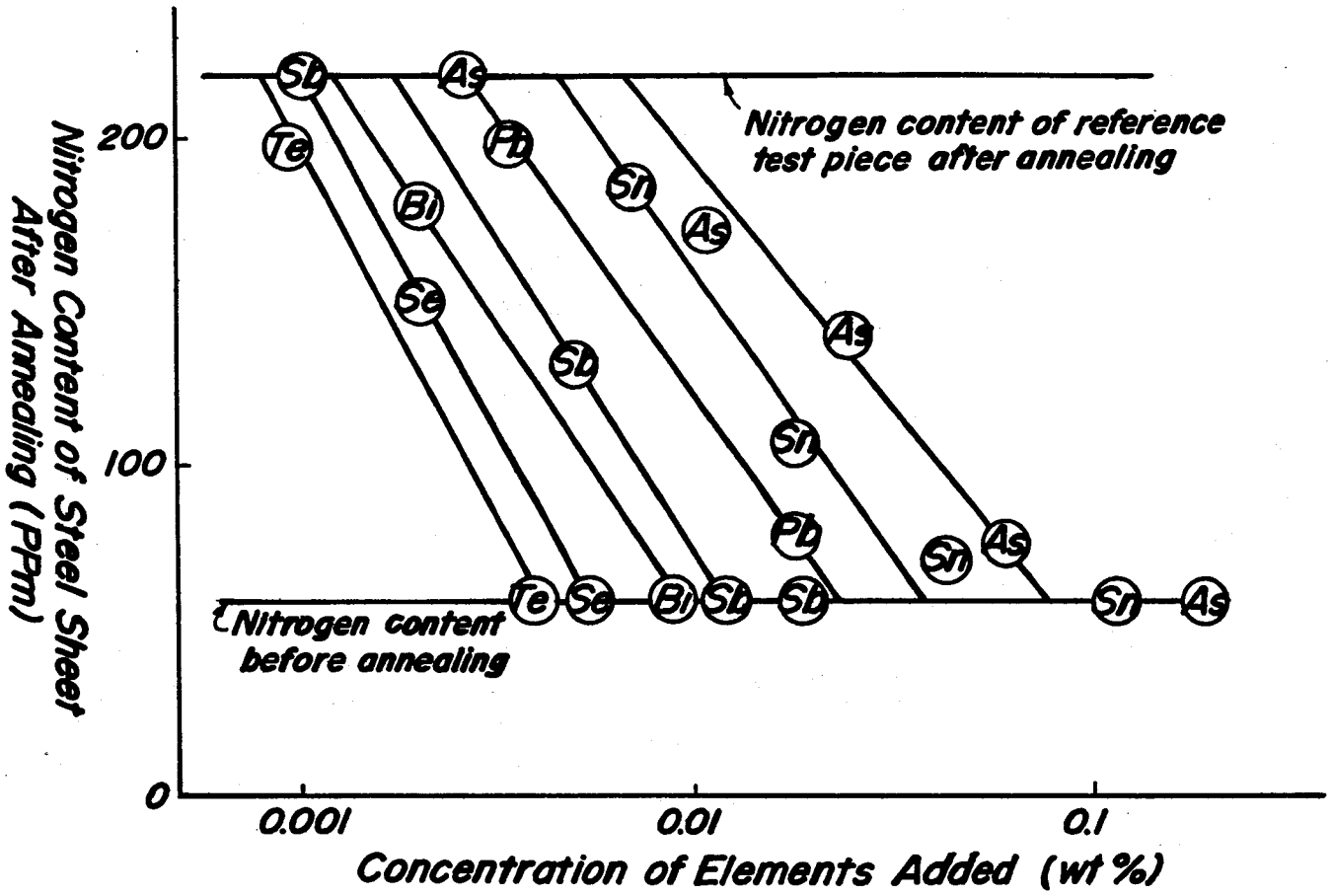

FIG. 5 illustrates the suppression of nitrogenization by application of anodic electrolysis, cathodic electrolysis, and alternating anodic and cathodic electrolyses, using aqueous solutions or suspensions of $NaAlO_2$, $SnCl_2.2H_2O$, $KH_2AsO_4$, $PbCl_2$, $SbCl_3$, $BiCl_3$, $Na_2SeO_3$, and $TeCl_4$. and FIG. 6 shows the suppression of nitrogenization during the recrystallization annealing by addition of different elements at different concentrations.

Tests were made on the suppression of graphite formation on steel sheet surfaces by applying different elements on the cold-rolled steel sheet specimens of 0.8 mm thick which were ready for recrystallization annealing. The composition of the sheet is shown in the following Table.

| Carbon | Manganese | Phosphorus | Sulfur | Iron |
|---|---|---|---|---|
| 0.043% | 0.32% | 0.006% | 0.018% | Substantially the balance |

Test pieces of 0.8mm(thickness)×30mm(width)×50mm(length) were cut out from each of the specimens, and after thorough degreasing, each test piece was chemically polished with a solution of 3% $HF+H_2O_2$. The test pieces were thoroughly washed with water and dried by hot air. A number of the test pieces thus treated (whose composition was as described in the last mentioned Table) were bound together and used as Reference Sheets (I).

After the chemical polishing, washing, and hot air drying, other test pieces were divided into six groups, which were dipped in aqueous solutions (80° C) of sulfur-containing compounds as shown in Table 1 for about ten seconds. The concentrations of the aqueous solutions for the different groups were 0.00001 mol/l, 0.0001 mol/l, 0.0005 mol/l, 0.001 mol/l, 0.01 mol/l, and 0.1 mol/l. The test pieces were dried after removing from the aqueous solutions or suspensions. Those test pieces which were treated by the same aqueous solution were bound together so as to keep wide surfaces of adjacent test pieces in tight contact with each other. All the test pieces, including the Reference Sheets (I) and the six groups, were subjected to recrystallization annealing at 700° C for 6 hours in a gaseous mixture atmosphere consisting of 7% of hydrogen and the remainder of nitrogen.

After the annealing, the binding of the test pieces was released, and X-ray diffraction tests were made on each group of test pieces at a 15×15 $mm^2$ area of surfaces which were kept in tight contact with adjacent test piece surfaces during the recrystallization annealing, for the purpose of determining the (002) peak heights of graphite of the test pieces. Thus, the amount of graphite formed on the surfaces of the test pieces was measured.

Table 1

Suppression of graphite formation by applying aqueous solutions of sulfur-containing compounds.

| Compound | | Degree of graphite formation,* for compound concentration (mol/l) | | | | | |
|---|---|---|---|---|---|---|---|
| No. | Composition | 0.00001 | 0.0001 | 0.0005 | 0.001 | 0.01 | 0.1 |
| 1 | $K_2S$ | C | A | A | A | A | A |
| 2 | $Na_2S_2O_3 . 5H_2O$ | C | A | A | A | A | A |
| 3 | $K_2S_2O_3 . 1/3H_2O$ | C | A | A | A | A | A |
| 4 | $Na_2S . 9H_2O$ | C | A | A | A | A | A |
| 5 | $Al_2(SO_4)_3 . 18H_2O$ | C | A | A | A | A | A |
| 6 | $FeSO_4 . 7H_2O$ | C | A | A | A | A | A |
| 7 | $KHSO_4$ | C | A | A | A | A | A |
| 8 | $NaHSO_3$ | C | A | A | A | A | A |
| 9 | $S_2Cl_2$ | C | A | A | A | A | A |
| 10 | $H_2SO_4$ | D | A | A | A | A | A |
| 11 | $K_2SO_4$ | D | B | A | A | A | A |
| 12 | $Al_2(SO_4)_3K_2SO_4 . 24H_2O$ | D | B | A | A | A | A |
| 13 | $FeSO_4(NH_4)_2SO_4 . 6H_2O$ | D | B | A | A | A | A |
| 14 | $CrSO_4 . 7H_2O$ | D | B | A | A | A | A |
| 15 | $CuSO_4 . 5H_2O$ | D | B | A | A | A | A |
| 16 | $K_2S_2O_7$ | D | B | B | A | A | A |
| 17 | $K_2S_2O_8$ | D | B | B | A | A | A |

Table 1-continued

Suppression of graphite formation by applying aqueous solutions of sulfur-containing compounds.

| Compound | | Degree of graphite formation,* for compound concentration (mol/l) | | | | | |
|---|---|---|---|---|---|---|---|
| No. | Composition | 0.00001 | 0.0001 | 0.0005 | 0.001 | 0.01 | 0.1 |
| 18 | $Na_2S_2O_7$ | D | B | B | A | A | A |
| 19 | $Na_2S_2O_8$ | D | B | B | A | A | A |
| 20 | $Na_2SO_3$ | D | B | B | A | A | A |
| 21 | $(NH_4)_2SO_4$ | D | B | B | A | A | A |
| 22 | $NH_4HSO_3$ | D | B | B | A | A | A |
| 23 | $(NH_4)_2S_2O_8$ | D | B | B | A | A | A |
| 24 | $NH_4OSO_2NH_2$ | D | B | B | A | A | A |
| 25 | $Na_2SO_4 . 10H_2O$ | D | B | B | A | A | A |
| 26 | $ZnSO_4 . 7H_2O$ | D | B | B | A | A | A |
| 27 | $Ti(SO_4)_2$ | D | B | B | A | A | A |

*A Less than 10% of graphite formation for Reference Sheet (I)
B 10% to 40% of graphite formation for Reference Sheet (I)
C 40% to 70% of graphite formation for Reference Sheet (I)
D More than 70% of graphite formation for Reference Sheet (I)

Table 1 shows the suppression of the graphite formation on the steel sheet test pieces during the recrystallization annealing, due to applications of the different kinds and concentrations of the sulfur-containing compounds prior to the annealing. The Reference Sheets (I) were annealed without applying any compounds on them.

As shown in Table 1, marked effect for the suppression of graphite formation on the steel sheet surfaces can be achieved, by applying one of the aqueous solutions containing 0.0001 mol/l or more of the sulfur-containing compounds; namely $K_2S$, $Na_2S_2O_3$, $K_2S_2O_3$, $Na_2S$, $Al_2(SO_4)_3$, $FeSO_4$, $KHSO_4$, and other sulfur-containing compounds of Table 1.

Among the compounds in Table 1, $H_2SO_4$ and $CuSO_4$ are not desirable, because $H_2SO_4$ is a strong acid and tends to corrode steel sheets, while $CuSO_4$ tends to deposit metallic copper on steel sheet surfaces and deteriorate the surface appearance of the steel sheets.

Separately, similar test pieces of cold-rolled low-carbon steel sheets to those of Table 1 were prepared, and after similar pretreatments, compounds containing aluminum, tin, arsenic, lead, antimony, bismuth, selenium, and tellurium, as shown in Tables 2 and 3, were applied to the test pieces. Those compounds which are difficult to dissolve in water were used as suspensions having a homogeneous dispersion of the element or elements.

In a group of test pieces used for each compound and/or for each concentration, the test pieces were bound together so as to keep the test pieces in tight contact with each other. All the test pieces were annealed at 700° C for 6 hours in an atmosphere consisting of 7% of hydrogen and the remainder of nitrogen. After the annealing, the amount of graphite formed on steel sheet surfaces was measured by X-ray diffraction.

Table 2

Suppression of graphite formation by applying aqueous solutions or suspensions of tin - or arsenic - containing compounds.

| Compound | | Degree of graphite formation,* for compound concentration (mol/l) | | | | | |
|---|---|---|---|---|---|---|---|
| No. | Composition | 0.00001 | 0.00005 | 0.0001 | 0.001 | 0.01 | 0.1 |
| 28 | Al)NO-$_3)_3 . 9H_2O$ | D | D | A | A | A | A |
| 29 | $AlCl_3 . 6H_2O$ | D | D | A | A | A | A |
| 30 | $SnCl_2 . 2H_2O$ | D | D | A | A | A | A |
| 31 | $Sn(NO_3)_4$ | D | D | A | A | A | A |
| 32 | $SnI_2$ | D | D | A | A | A | A |
| 33 | $As_2S_3$ | D | C | A | A | A | A |
| 34 | $NaAsO_2$ | D | C | A | A | A | A |
| 35 | $H_3AsO_4$ | D | C | A | A | A | A |
| 36 | $KH_2AsO_4$ | D | C | A | A | A | A |
| 37 | $Na_2HAsO_3$ | D | C | A | A | A | A |
| 38 | $(NH_4)_3$ | D | C | A | A | A | A |

Table 2-continued

Suppression of graphite formation by applying aqueous solutions or suspensions of tin - or arsenic - containing compounds.

| Compound | | Degree of graphite formation,* for compound concentration (mol/l) | | | | | |
|---|---|---|---|---|---|---|---|
| No. | Composition | 0.00001 | 0.00005 | 0.0001 | 0.001 | 0.01 | 0.1 |
| | $AsO_4 . 3H_2O$ | | | | | | |
| 39 | $AsCl_3$ | D | C | A | A | A | A |
| 40 | $As_2O_3$ | D | C | A | A | A | A |
| 41 | $K_3AsO_3$ | D | C | A | A | A | A |

*A Less than 10% of graphite formation for Reference Sheet (I)
B 10% to 40% of graphite formation for Reference Sheet (I)
C 40% to 70% of graphite formation for Reference Sheet (I)
D More than 70% of graphite formation for Reference Sheet (I)

Table 3

Suppression of graphite formation by applying aqueous solutions or suspensions of compounds containing lead, antimony, bismuth, selenium, or tellurium.

| Compound | | Degree of graphite formation,* for compound concentration (mol/l) | | | | | |
|---|---|---|---|---|---|---|---|
| No. | Composition | 0.00001 | 0.00005 | 0.0001 | 0.001 | 0.01 | 0.1 |
| 42 | $PbCl_2$ | B | A | A | A | A | A |
| 43 | $Pb_2O(OH)_2$ | B | A | A | A | A | A |
| 44 | $Pb(NO_3)_2$ | B | A | A | A | A | A |
| 45 | $Pb(CH_3-$ $COO)_2 . 3H_2O$ | B | A | A | A | A | A |
| 46 | $SbCl_3$ | B | A | A | A | A | A |
| 47 | $SbBr_3$ | B | B | A | A | A | A |
| 48 | SbOCl | B | A | A | A | A | A |
| 49 | $Sb_2(SO_4)_3$ | B | B | A | A | A | A |
| 50 | $Sb_2O_3$ | B | B | A | A | A | A |
| 51 | $NaBiO_3$ | B | A | A | A | A | A |
| 52 | $BiCl_3$ | B | A | A | A | A | A |
| 53 | $Bi_2(SO_4)_3$ | B | B | A | A | A | A |
| 54 | $Bi(NO_3)_3 . 5-$ $H_2O$ | B | B | A | A | A | A |
| 55 | $H_2SeO_3$ | B | A | A | A | A | A |
| 56 | $Se_2Cl_2$ | B | A | A | A | A | A |
| 57 | $SeOCl_2$ | B | A | A | A | A | A |
| 58 | $SeS_2$ | B | A | A | A | A | A |
| 59 | $H_2SeO_4$ | B | B | A | A | A | A |
| 60 | $SeO_2$ | B | B | A | A | A | A |
| 61 | $K_2Se$ | B | B | A | A | A | A |
| 62 | $Na_2Se$ | B | B | A | A | A | A |
| 63 | $K_2SeO_3$ | B | B | A | A | A | A |
| 64 | $K_2SeO_4$ | B | B | A | A | A | A |
| 65 | $Na_2SeO_3$ | B | B | A | A | A | A |
| 66 | $Na_2SeO_4$ | B | B | A | A | A | A |
| 67 | $H_2TeO_4 . 2H_2O$ | B | A | A | A | A | A |
| 68 | $K_2TeO_3$ | B | A | A | A | A | A |
| 69 | $K_2TeO_4 . 5H_2O$ | B | A | A | A | A | A |
| 70 | $Na_2TeO_3$ | B | A | A | A | A | A |
| 71 | $Na_2TeO_4$ | B | A | A | A | A | A |
| 72 | $TeCl_4$ | B | A | A | A | A | A |

*A Less than 10% of graphite formation for Reference Sheet (I)
B 10% to 40% of graphite formation for Reference Sheet (I)

Table 2 and Table 3 illustrate the suppression of the graphite formation due to the application of the aqueous solution or suspension of the specific compounds onto the steel sheet surfaces prior to the annealing.

As shown in Table 2 and Table 3, notable suppression of graphite formation on the steel sheet surfaces can be achieved by applying one of the aqueous solutions and suspensions which either contain 0.0001 mol/l or more of the specific compounds containing aluminum, tin, or arsenic, or contain 0.00001 mol/l or more of the specific compounds having lead, antimony, bismuth, selenium, or tellurium.

Tests were made also on the suppression of nitrogenization by application of specific compounds. Test specimens were made from 0.8 mm thick cold-rolled low-carbon aluminum-killed steel sheet which was ready for recrystallization annealing. The composition of the steel sheet is shown in the following Table.

| Carbon | Silicon | Manganese | Phosphorus | Sulfur | Aluminum | Nitrogen | Iron |
|---|---|---|---|---|---|---|---|
| 0.041% | 0.009% | 0.31% | 0.008% | 0.014% | 0.045% | 0.006% | Substantially the balance |

Test pieces of 0.8 mm(thickness)×30 mm(width)×50 mm(length) were cut out from each of the specimens, and after thorough degreasing, each test piece was chemically polished with a solution of 3% $HF+H_2O_2$. The test pieces were thoroughly washed with water and dried by hot air. Three of the test pieces thus treated (whose composition was as described in the above Table) were bound together and used as Reference Sheets (II).

The chemical polishing was applied to the test pieces, in order to achieve uniform clean surfaces for ensuring a high reproducibility of the tests on the suppression of nitrogenization of the steel sheets.

After the chemical polishing, washing, and hot air drying, test pieces were divided into seven groups, which were dipped into the aqueous solutions or suspensions (80° C) of the compounds as shown in Table 4 for ten seconds. The concentrations of the aqueous solutions or suspensions were 0.00001 mol/l, 0.00005 mol/l, 0.0001 mol/l, 0.0005 mol/l, 0.001 mol/l, 0.01 mol/l, and 0.1 mol/l. The test pieces were dried after removing from the aqueous solutions or suspensions. Three test pieces, which were treated by the same aqueous solution or suspension, were bound together so as to keep test pieces in tight contact with each other. All the test pieces were subjected to recrystallization annealing at 700° C for 20 hours in an atmosphere consisting of 7% of hydrogen and the remainder of nitrogen.

After the annealing, the binding of the three test pieces of each group was released, and the total nitrogen for the full-thickness-sample of the midmost test piece in the three test pieces was determined by chemical analysis. The results are shown in Table 4.

Table 4

Suppression of nitrogenization by applying aqueous solutions or suspensions of compounds containing sulfur, aluminum, tin, arsenic, lead, antimony, bismuth, selenium, or tellurium.

| Compound | | Total content (Wt. %) of nitrogen for full sheet-thickness, for compound concentration (mol/l) | | | | | | |
|---|---|---|---|---|---|---|---|---|
| No. | Composition | 0.00001 | 0.00005 | 0.0001 | 0.0005 | 0.001 | 0.01 | 0.1 |
| 1 | $K_2S$ | — | 0.0212 | 0.0190 | 0.0101 | 0.0080 | 0.0071 | 0.0065 |
| 2 | $FeSO_4 . 7H_2O$ | — | 0.0200 | 0.0182 | 0.0097 | 0.0082 | 0.0068 | 0.0067 |
| 3 | $Al_2(SO_4)_3 . 18H_2O$ | — | 0.0198 | 0.0135 | 0.0082 | 0.0072 | 0.0065 | 0.0061 |
| 4 | $NaAlO_2$ | — | 0.0204 | 0.0190 | 0.0098 | 0.0083 | 0.0069 | 0.0062 |
| 5 | $AlCl_3$ | — | 0.0210 | 0.0195 | 0.0100 | 0.0085 | 0.0071 | 0.0063 |
| 6 | $SnCl_2 . 2H_2O$ | — | 0.0192 | 0.0156 | 0.0096 | 0.0078 | 0.0068 | 0.0062 |
| 7 | $Sn(NO_3)_4$ | — | 0.0205 | 0.0134 | 0.0087 | 0.0073 | 0.0064 | 0.0060 |
| 8 | $SnI_4$ | — | 0.0185 | 0.0125 | 0.0089 | 0.0072 | 0.0065 | 0.0060 |
| 9 | $As_2S_3$ | — | 0.0190 | 0.0135 | 0.0090 | 0.0084 | 0.0072 | 0.0061 |
| 10 | $NaAsO_2$ | — | 0.0205 | 0.0136 | 0.0089 | 0.0081 | 0.0075 | 0.0060 |
| 11 | $KH_2AsO_4$ | — | 0.0210 | 0.0140 | 0.0093 | 0.0085 | 0.0067 | 0.0060 |
| 12 | $Na_2HAsO_3$ | — | 0.0195 | 0.0145 | 0.0087 | 0.0075 | 0.0070 | 0.0060 |
| 13 | $(NH_4)_3AsO_4 . 3H_2O$ | — | 0.0187 | 0.0160 | 0.0090 | 0.0083 | 0.0069 | 0.0062 |
| 14 | $AsCl_3$ | — | 0.0195 | 0.0158 | 0.0095 | 0.0068 | 0.0073 | 0.0065 |
| 15 | $As_2O_3$ | — | 0.0193 | 0.0155 | 0.0089 | 0.0083 | 0.0074 | 0.0062 |
| 16 | $K_3AsO_3$ | — | 0.0188 | 0.0140 | 0.0088 | 0.0078 | 0.0068 | 0.0060 |
| 17 | $PbCl_2$ | 0.0112 | 0.0070 | 0.0063 | — | 0.0064 | 0.0058 | 0.0060 |
| 18 | $Pb_2O(OH)_2$ | 0.0120 | 0.0075 | 0.0070 | — | 0.0060 | 0.0062 | 0.0059 |
| 19 | $Pb(NO_3)_2$ | 0.0131 | 0.0084 | 0.0065 | — | 0.0058 | 0.0060 | 0.0061 |
| 20 | $Pb(CH_3COO)_2 . 3H_2O$ | 0.0115 | 0.0075 | 0.0060 | — | 0.0059 | 0.0058 | 0.0060 |
| 21 | $SbCl_3$ | 0.0125 | 0.0070 | 0.0059 | — | 0.0060 | 0.0059 | 0.0057 |
| 22 | $SbBr_3$ | 0.0130 | 0.0083 | 0.0071 | — | 0.0059 | 0.0061 | 0.0060 |
| 23 | SbOCl | 0.0115 | 0.0075 | 0.0064 | — | 0.0065 | 0.0063 | 0.0058 |
| 24 | $Sb_2(SO_4)_3$ | 0.0134 | 0.0078 | 0.0068 | — | 0.0060 | 0.0065 | 0.0059 |
| 25 | $Sb_2O_3$ | 0.0140 | 0.0085 | 0.0065 | — | 0.0073 | 0.0063 | 0.0060 |
| 26 | $NaBiO_3$ | 0.0123 | 0.0075 | 0.0058 | — | 0.0061 | 0.0058 | 0.0060 |
| 27 | $BiCl_3$ | 0.0110 | 0.0067 | 0.0060 | — | 0.0058 | 0.0058 | 0.0059 |
| 28 | $Bi_2(SO_4)_3$ | 0.0114 | 0.0070 | 0.0061 | — | 0.0063 | 0.0060 | 0.0061 |
| 29 | $Bi(NO_3)_3 . 5H_2O$ | 0.0113 | 0.0065 | 0.0063 | — | 0.0059 | 0.0060 | 0.0058 |
| 30 | $H_2SeO_3$ | 0.0154 | 0.0093 | 0.0067 | — | 0.0063 | 0.0058 | 0.0060 |
| 31 | $Se_2Cl_2$ | 0.0143 | 0.0095 | 0.0070 | — | 0.0061 | 0.0065 | 0.0059 |
| 32 | $SeOCl_2$ | 0.0125 | 0.0087 | 0.0065 | — | 0.0065 | 0.0063 | 0.0060 |
| 33 | $SeS_2$ | 0.0133 | 0.0089 | 0.0073 | — | 0.0058 | 0.0058 | 0.0060 |
| 34 | $H_2SeO_4$ | 0.0140 | 0.0091 | 0.0075 | — | 0.0063 | 0.0060 | 0.0060 |
| 35 | $SeO_2$ | 0.0138 | 0.0096 | 0.0067 | — | 0.0065 | 0.0065 | 0.0061 |
| 36 | $K_2Se$ | 0.0142 | 0.0093 | 0.0061 | — | 0.0060 | 0.0060 | 0.0058 |
| 37 | $Na_2Se$ | 0.0135 | 0.0085 | 0.0072 | — | 0.0060 | 0.0062 | 0.0060 |
| 38 | $K_2SeO_3$ | 0.0140 | 0.0087 | 0.0066 | — | 0.0071 | 0.0064 | 0.0058 |
| 39 | $K_2SeO_4$ | 0.0134 | 0.0098 | 0.0078 | — | 0.0070 | 0.0066 | 0.0064 |
| 40 | $Na_2SeO_3$ | 0.0155 | 0.0088 | 0.0073 | — | 0.0063 | 0.0067 | 0.0060 |
| 41 | $Na_2SeO_4$ | 0.0160 | 0.0093 | 0.0074 | — | 0.0066 | 0.0066 | 0.0061 |
| 42 | $H_2TeO_4 . 2H_2O$ | 0.0107 | 0.0067 | 0.0059 | — | 0.0058 | 0.0058 | 0.0060 |
| 43 | $K_2TeO_3$ | 0.0113 | 0.0073 | 0.0062 | — | 0.0058 | 0.0057 | 0.0059 |
| 44 | $K_2TeO_4 . 5H_2O$ | 0.0110 | 0.0068 | 0.0063 | — | 0.0057 | 0.0059 | 0.0060 |
| 45 | $Na_2TeO_3$ | 0.0115 | 0.0075 | 0.0067 | — | 0.0060 | 0.0061 | 0.0060 |
| 46 | $Na_2TeO_4$ | 0.0130 | 0.0080 | 0.0060 | — | 0.0059 | 0.0062 | 0.0058 |
| 47 | $TeCl_4$ | 0.0118 | 0.0074 | 0.0060 | — | 0.0062 | 0.0060 | 0.0059 |

Table 4-continued

| | Suppression of nitrogenization by applying aqueous solutions or suspensions of compounds containing sulfur, aluminum, tin, arsenic, lead, antimony, bismuth, selenium, or tellurium. | |
|---|---|---|
| | Compound | Total content (Wt. %) of nitrogen for full sheet-thickness, for compound concentration (mol/l) |
| Reference Sheet (II) | Not coated | 0.0225 ~ 0.0245 |

As shown in Table 4, notable suppression of the nitrogenization during the recrystallization annealing can be achieved by applying to the steel sheet surfaces, prior to the recrystallization annealing, one of the aqueous solutions or suspensions which contain either 0.0005 mol/l or more of the specific compounds containing sulfur, aluminum, tin, and arsenic, or 0.00005 mol/l or more of the compounds containing lead, antimony, bismuth, selenium, and tellurium.

Based on the results of the aforesaid tests, restrictions to the process according to the present invention will now be described.

As regards the chemical composition of the low-carbon steel sheets, all the commercial cold-rolled low-carbon steel sheets in a market can be treated by the process of the present invention for suppressing the graphite formation. In addition to this purpose, steel sheets containing element or elements of nitride former and low-nitrogen rimmed steel sheet can be treated by the process according to the present invention for suppressing the nitrogenization during the recrystallization annealing.

The cold-rolled low-carbon steel sheet, which is to be treated by the process of the present invention, is made by the following steps; namely, melting in a steel making furnace, e.g., a converter, making ingot from the melt, forming slab by rolling the ingot or by continuous casting, continuously hot-rolling to coil, pickling, cold-rolling in a conventional fashion, and applying recrystallization annealing either immediately after the cold-rolling or after degreasing following the cold-rolling.

The degreasing following the cold-rolling is usually performed either by brushing in an aqueous solution containing sodium hydroxide or sodium orthosilicate, or by applying electrolysis in these aqueous solutions. After the degreasing, the cold-rolled low-carbon steel sheets are washed with water, dried with hot air, and subjected to the recrystallization annealing.

Accordingly, with the process of the present invention, the aqueous solution or the suspension can be applied to the steel sheet surfaces by any of the following methods.

a. If the steel sheets are to be degreased after the cold-rolling, the aqueous solution or the suspension may be used as a rinsing solution. Instead, after completing the washing with water following the degreasing, the aqueous solution or the suspension may be uniformly applied to the steel sheet surfaces by dipping, spraying, injecting, or transferring.

b. If the steel sheets are to be subjected to the recrystallization annealing immediately after the cold-rolling without degreasing, the compounds which are essential for the aqueous solution or the suspension may be added in a lubricant or a coolant oil for the cold-rolling. Instead, after the cold-rolling, the aqueous solution or the suspension may be uniformly applied to the steel sheet surfaces by dipping, spraying, injecting, or transferring.

In the case of the aforesaid method (b), the steel sheets need not be dried after applying the aqueous solution or the suspension of the invention, because the rolling mill lubricant has corrosion-resisting effect. In the case of the aforesaid method (a), however, the steel sheets are preferably dried after the application of the aqueous solution or the suspension of the invention, in order to prevent corrosion due to the moisture of the solution or the suspension. The process of drying has no bearing on the effect of suppressing the graphite formation and suppressing the nitrogenization during the recrystallization annealing.

The inventors have found that the amount of 2 g/m$^2$ or more of the aqueous solutions or suspensions on the surface of sheet is sufficient for fulfilling the objects of the invention. Thus, regardless of the methods of applying the aqueous solutions or the suspensions, the amount of the aqueous solutions or suspensions in excess of 2 g/m$^2$ must be ensured for successfully achieving the objects of the invention.

As can be seen from the foregoing Tables, the level of the suppression of the graphite formation and the nitrogenization is reduced if the concentrations of the compounds in the aqueous solutions or the suspensions are too low, but the desired level of the suppression may be achieved by repeatedly applying the aqueous solutions or suspensions with very low concentrations.

The concentration of the compound or compounds in the aqueous solutions or the suspensions should preferably be 0.1 mol/l or smaller, because excessive compounds may cause deterioration of the appearance of the steel sheet surfaces and a cost rise.

Two or more of the compounds can be added in the aqueous solutions or the suspensions before applying to the steel sheet surfaces. The level of suppressing the graphite formation and the nitrogenization by the simultaneous use of the two or more of the compounds will be substantially equivalent to the sum of the corresponding levels which can be achieved by separately using those compounds. Accordingly, if repeated applications or the simultaneous application of the two or more compounds is used, the desired level of suppressing the graphite formation and the nitrogenization during the recrystallization annealing can be achieved, as long as the concentration of at least one compound in one of the aqueous solutions or suspensions thus applied is sufficient for such purpose.

The invention will now be described in further detail by referring to examples.

EXAMPLE 1

Commercial low-carbon steel was melted in a 200-ton converter for making ingots, and rolled to slabs; hot-rolled to coils, pickled, and cold-rolled (at a reduction ratio of 70%) in a conventional fashion.

The chemical composition of the low-carbon steel at ladle is shown in the following Table.

| Carbon | Manganese | Phosphorus | Sulfur | Iron |
|---|---|---|---|---|
| 0.04%-0.05% | 0.30%-0.35% | 0.007%-0.01% | 0.015%-0.020% | Substantially the remainder |

10 coils, No. 1 to No. 10, were prepared by degreasing after the cold-rolling. Six coils, i.e., No. 1, No. 2, No. 3, No. 4, No. 5, and No. 6, were applied with 0.001 mol/l aqueous solutions of $Na_2S_2O_3.5H_2O$, $Al_2(SO_4)_3.18H_2O$, $Na_2SO_4$, $SbCl_3$, $SnCl_2.2H_2O$, and $K_2TeO_3$, respectively. These aqueous solutions were dripped onto the steel sheet surfaces after the degreasing but before the drying of rinsing water, and to achieve a uniform coverage at the amount of about 10 g/m² of aqueous solutions, the steel sheets were squeezed by rubber roll before drying the aqueous solutions with hot air. Four coils, i.e., No. 7 to No. 10, were similarly covered with the four mixtures by dripping and squeezing to achieve the amount of about 10 g/m² of aqueous solutions, as shown in Table 5. The four mixtures were those of $Al_2(SO_4)_3$ plus $Na_2S_2O_3$; $Na_2S_2O_3$ plus $Na_2SO_4$; $SbCl_3$ plus $Al_2(SO_4)_3$; and $SbCl_3$ plus $SnCl_2$. $_2$. The concentrations of the two compounds in each of the four mixtures are shown in Table 5.

Table 5

Suppression of graphite formation by applying aqueous solutions or suspensions of compounds containing sulfur, aluminum, tin, antimony, or tellurium.

| Applying conditions | Compound applied to steel sheet surface No. | Composition | Concentration (mol/l) | Rejection rate (%), due to graphite formation |
|---|---|---|---|---|
| Applied to cold-rolled steel sheet after degreasing | 1 | $Na_2S_2O_3 . 5H_2O$ | 0.001 | 0 |
| | 2 | $Al_2(SO_4)_3 . 18H_2O$ | " | 0 |
| | 3 | $Na_2SO_4 . 10H_2O$ | " | 0.6 |
| | 4 | $SbCl_3$ | " | 0 |
| | 5 | $SnCl_2$ | " | 0 |
| | 6 | $K_2TeO_3$ | " | 0 |
| | 7 | $Al_2(SO_4)_3 \cdot 18H_2O$ | 0.0005 | 0 |
| | | $Na_2S_2O_3 . 5H_2O$ | 0.00005 | |
| | 8 | $Na_2S_2O_3 . 5H_2O$ | 0.0005 | 0.4 |
| | | $Na_2SO_4 . 10H_2O$ | 0.00005 | |
| | 9 | $SbCl_3$ | 0.00005 | 0 |
| | | $Al_2(SO_4)_3 . 18H_2O$ | 0.00005 | |
| | 10 | $SbCl_3$ | 0.00005 | 0.5 |
| | | $SnCl_2 . 2H_2O$ | 0.00005 | |
| Applied to cold-rolled steel sheet without degreasing | 11 | $Na_2S_2O_3 . 5H_2O$ | 0.001 | 0 |
| | 12 | $Al_2(SO_4)_3 . 18H_2O$ | " | 0 |
| | 13 | $Na_2SO_4 . 10H_2O$ | " | 1.2 |
| | 14 | $SbCl_3$ | " | 0 |
| | 15 | $K_2TeO_3$ | " | 0 |
| Without any treatment (only degreasing is applied) | 16 | Not applied | — | 65.8 |
| | 17 | " | — | 87.4 |
| | 18 | " | — | 49.2 |

Five coils, i.e., No. 11 to No. 15, were treated as cold-rolled without degreasing; namely, 0.001 mol/l aqueous solutions of $Na_2S_2O_3.5H_2O$, $Al_2(SO_4)_3.18H_2O$, $Na_2SO_4$, $SbCl_3$, and $K_2TeO_3$ were dripped onto the surfaces of the steel sheets forming the five coils, so as to achieve a uniform coverage at the amount of about 10 g/m² of aqueous solutions.

All the coils thus treated were subjected to the recrystallization annealing in an HNX gas atmosphere in the tightly wound coil condition. The rejection rates (by weight) of the coils thus annealed, due to the graphite formation on the steel sheet surfaces, are shown in Table 5. Table 5 also shows the corresponding rejection rates for reference coils, i.e. coils No. 16 to No. 18, which were identical with the aforesaid coils No. 1 to No. 15 except that they were not treated by the process according to the present invention.

As shown in Table 5, steel sheet surface defects due to the graphite formation thereon, as experienced in non-treated steel coils, can be almost completely eliminated by applying the process according to the present invention.

EXAMPLE 2

In order to demonstrate the effect of the suppression of nitrogenization during the recrystallization annealing by applying the process according to the present invention, the following tests were made.

Commercial aluminum killed steel was melted by converter for making ingots, and rolled to slabs, hot-rolled to coils, pickled and cold-rolled (at a reduction ratio of 70%) in a conventional fashion.

The chemical composition of the aluminum killed steel at ladle, except the aluminum and nitrogen contents in Table 6, is shown in the following Table.

| Carbon | Manganese | Phosphorus | Sulfur |
|---|---|---|---|
| 0.03%-0.05% | 0.30%-0.35% | 0.007%-0.01% | 0.015%-0.020% |

Eleven steel sheet coils, No. 1 to No. 11, were prepared by degreasing after the cold-rolling. Eight coils, i.e., No. 1 to No. 8, were covered with 0.001 mol/l aqueous solutions or suspensions of $SnCl_2.2H_2O$, $KH_2AsO_4$, $Al_2(SO_4)_3.18H_2O$, $PbCl_2$, $SbCl_3$, $BiCl_3$, $K_2SeO_3$, and $K_2TeO_3$, respectively. The aqueous solutions were dripped onto the steel sheet surfaces after the degreasing but before the drying of rinsing water, and to achieve a uniform coverage at the amount of about 10 g/m² of aqueous solutions, the steel sheets were rolled before drying the aqueous solutions with hot air. Three coils, i.e., No. 9 to No. 11, were similarly covered with the three mixtures by dripping and rolling to achieve the amount of about 10 g/m² of aqueous solutions, as shown in Table 6. The three mixtures were those of $Al_2(SO_4)_3$ plus $SbCl_3$; $K_2TeO_3$ plus $Al_2(SO_4)_3$; and $SbCl_3$ plus $SnCl_2$. The ratios of the two compounds in each of the three mixtures are shown in Table 6.

Five coils, i.e., No. 12 to No. 16, were treated as cold-rolled without degreasing; namely, 0.001 mol/l aqueous solutions of $Al_2(SO_4)_3$. $18H_2O$, $SbCl_3$, $K_2TeO_3$, and $K_2SeO_3$ were dripped onto the surfaces of the steel sheets forming four of the five coils, i.e., No. 12 to No. 15, on the other hand, a mixed suspension containing 0.0005 mol/l of $Al_2(SO_4)_3.18H_2O$ and 0.00005 mol/l of $K_2TeO_3$ was dripped onto surface of coil No. 16. All solutions were applied so as to achieve a uniform coverage at the amount of about 10 g/m² of aqueous solutions on all of the coils No. 11 to No. 16.

All the coils thus treated were subjected to the recrystallization annealing in a HNX gas atmosphere in the tightly wound coil condition. Nitrogen contents of the coils before and after the recrystallization annealing are shown in Table 6. Table 6 also shows the corresponding variation of nitrogen contents for reference coils, i.e., No. 17 to No. 20, which were identical with the aforesaid coils No. 1 to No. 16 except that they were not treated by the process according to the present invention Table 6

Suppression of nitrogenization by applying aqueous solutions or suspensions of compounds containing tin, arsenic, aluminum, lead, antimony, bismuth, selenium, or tellurium on the surface of cold-rolled aluminum-killed steel sheet.

| Applying conditions | Compound applied to steel sheet surface No. | Composition | Concentration (mol/l) | Aluminum (Wt.%) | Nitrogen (Wt.%) Before annealing | After annealing |
|---|---|---|---|---|---|---|
| Applied to cold-rolled steel sheet after degreasing | 1 | $SnCl_2 . 2H_2O$ | 0.001 | 0.045 | 0.0048 | 0.0075 |
| | 2 | $KH_2AsO_4$ | " | 0.042 | 0.0054 | 0.0068 |
| | 3 | $Al_2(SO_4)_3 . 18H_2O$ | " | 0.033 | 0.0064 | 0.0076 |
| | 4 | $PbCl_2$ | " | 0.038 | 0.0054 | 0.0057 |
| | 5 | $SbCl_3$ | " | 0.050 | 0.0052 | 0.0055 |
| | 6 | $BiCl_3$ | " | 0.035 | 0.0060 | 0.0061 |
| | 7 | $K_2SeO_3$ | " | 0.030 | 0.0058 | 0.0060 |
| | 8 | $K_2TeO_3$ | " | 0.043 | 0.0066 | 0.0065 |
| | 9 | $Al_2(SO_4)_3 . 18H_2O$<br>$SbCl_3$ | 0.0005<br>0.00001 | 0.029 | 0.0048 | 0.0055 |
| | 10 | $Al_2(SO_4)_3 . 18H_2O$<br>$K_2TeO_3$ | 0.0005<br>0.00001 | 0.044 | 0.0050 | 0.0060 |
| | 11 | $SbCl_3$<br>$SnCl_2 . 2H_2O$ | 0.00005<br>0.0001 | 0.046 | 0.0056 | 0.0073 |
| Applied to cold-rolled steel sheet without degreasing | 12 | $Al_2(SO_4)_3 . 18H_2O$ | 0.001 | 0.042 | 0.0053 | 0.0078 |
| | 13 | $SbCl_3$ | " | 0.040 | 0.0056 | 0.0065 |
| | 14 | $K_2TeO_3$ | " | 0.050 | 0.0063 | 0.0065 |
| | 15 | $K_2SeO_3$ | " | 0.035 | 0.0060 | 0.0068 |
| | 16 | $Al_2(SO_4)_3 . 18H_2O$<br>$K_2TeO_3$ | 0.0005<br>0.0001 | 0.038 | 0.0055 | 0.0070 |
| Without any treatment (only degreasing is applied) | 17 | Not applied | — | 0.028 | 0.0055 | 0.0128 |
| | 18 | " | — | 0.039 | 0.0064 | 0.0142 |
| | 19 | " | — | 0.046 | 0.0050 | 0.0210 |
| | 20 | " | — | 0.055 | 0.0060 | 0.0240 |

As shown in Table 6, detrimental effects due to the nitrogenization during the recrystallization annealing, as experienced in non-treated steel coils, can be almost completely eliminated by applying the process according to the present invention.

EXAMPLE 3

Regular silicon steel containing aluminum was melted by a converter for making ingots, and rolled to slabs, hot-rolled to coils, pickled and cold-rolled in a conventional fashion. The contents of silicon, aluminum, and nitrogen in silicon steel thus treated are shown in Table 7.

Six steel sheet coils No. 1 to No. 6, were prepared by degreasing after the cold-rolling. Four couls, i.e., No. 1, No. 2, No. 3 and No. 4, were covered with 0.001 mol/l aqueous solutions or suspensions of $Al_2(SO_4)_3.18H_2O$, $PbCl_2$, $SbCl_3$, and $K_2TeO_3$, respectively. The aqueous solutions or suspensions were dripped onto the steel sheet surfaces after the degreasing but before the drying of rinsing water, and to achieve a uniform coverage at the amount of about 10 g/m²of aqueous solutions, the steel sheets were squeezed before drying the aqueous solutions with hot air. Two coils, i.e., No. 5 and No. 6, were similarly covered with the two mixtures by dripping and rolling to achieve the amount of about 10 g/m² of aqueous solutions, as shown in Table 7. The two mixtures were those of $Al_2(SO_4)_3$ plus $SbCl_3$, $Al_2(SO_4)_3$ plus $K_2TeO_3$. The concentrations of the two compounds in each of the two mixtures are shown in Table 7.

Four coils, i.e., No. 7 to No. 10, were treated as cold-rolled without degreasing; namely, 0.001 mol/l aqueous solutions or suspensions of $Al_2(SO_4)_3.18H_2O$, $SbCl_3$, and $K_2TeO_3$, were dripped onto the surfaces of three coils, i.e., No. 7 to No. 9, on the other hand mixed suspension containing 0.0005 mol/l of $Al_2(SO_4)_3.18H_2O$ and 0.00001 mol/l of $K_2TeO_3$ were dripped onto the coil No. 10, so as to achieve a uniform coverage at the amount of about 10 g/m² of aqueous solutions for all the four coils No. 7 to No. 10.

All the coils thus treated were subjected to the recrystallization annealing in an HNX gas atmosphere in the tightly wound coil condition. The nitrogen contents of the coils before and after the annealing are shown in Table 7. Table 7 also shows the corresponding nitrogen content variation for typical conventional silicon steel coils, i.e., coils No. 11 to No. 13, which were identical with the aforesaid coils No. 1 to No. 10 except that they were not treated by the process according to the present invention.

Table 7

Suppression of nitrogenization by applying aqueous solutions or suspensions of aluminum-, lead-, antimony-, or tellurium-containing compounds on the surface of silicon-steel sheet.

| Applying conditions | Compound applied to steel sheet surface No. | Composition | Concentration (mol/l) | Silicon (Wt.%) | Aluminum (Wt.%) | Nitrogen (Wt.%) Before annealing | After annealing |
|---|---|---|---|---|---|---|---|
| Applied to silicon steel sheet after degreasing | 1 | $Al_2(SO_4)_3 \cdot 18H_2O$ | 0.001 | 1.40 | 0.30 | 0.0065 | 0.0078 |
| | 2 | $PbCl_2$ | " | 1.35 | 0.25 | 0.0062 | 0.0070 |
| | 3 | $SbCl_3$ | " | 1.45 | 0.15 | 0.0057 | 0.0067 |
| | 4 | $K_2TeO_3$ | " | 1.40 | 0.20 | 0.0063 | 0.0067 |
| | 5 | $Al_2(SO_4)_3 \cdot 18H_2O$ | 0.0005 | 1.36 | 0.25 | 0.0055 | 0.0080 |
| | | $SbCl_3$ | 0.00001 | | | | |
| | 6 | $Al_2(SO_4)_3 \cdot 18H_2O$ | 0.0005 | 0.90 | 0.35 | 0.0060 | 0.0075 |
| | | $K_2TeO_3$ | 0.00001 | | | | |
| Applied after cold-rolling without degreasing | 7 | $Al_2(SO_4)_3 \cdot 18H_2O$ | 0.001 | 1.45 | 0.35 | 0.0064 | 0.0080 |
| | 8 | $SbCl_3$ | " | 1.35 | 0.20 | 0.0067 | 0.0074 |
| | 9 | $K_2TeO_3$ | " | 0.95 | 0.30 | 0.0055 | 0.0066 |
| | 10 | $Al_2(SO_4)_3 \cdot 18H_2O$ | 0.0005 | 1.20 | 0.25 | 0.0060 | 0.0075 |
| | | $K_2TeO_3$ | 0.00001 | | | | |
| Without any treatment (only degreasing is applied) | 11 | Not applied | — | 1.20 | 0.20 | 0.0066 | 0.0350 |
| | 12 | " | — | 1.40 | 0.25 | 0.0062 | 0.0330 |
| | 13 | " | — | 1.30 | 0.30 | 0.0057 | 0.0290 |

As shown in Table 7, detrimental effects due to nitrogenization during the recrystallization annealing, as experienced in non-treated steel coils, can be almost completely eliminated by applying the process according to the present invention.

A method of applying the compound or compounds by electrolysis will now be described. With the electrolytic method, the steel sheet, which is either as cold-rolled or as degreased after the cold-rolling, is electrolytically treated by passing it in an electrolyte bath with an electric charge of 1 to 20 coulombs. Into this electrolyte bath, at least one compound containing sulfur, aluminum, tin, arsenic, lead, bismuth, selenium, and/or tellurium was added. This electrolytic treatment is, of course, to suppress the graphite formation on the surface of the steel sheet and nitrogenization of the steel sheet during the succeeding recrystallization annealing. If the electrolytic treatment is applied to steel sheet which is not degreased, the electrolytic treatment also fulfills the function of degreasing.

The aforesaid electrolytic treatment has been developed as a result of series of tests which will now be described.

A 10 Kg steel ingot was made in an experimental vacuum high-frequency furnace by using high-purity electrolytic iron. The steel ingot was hot-forged and hot-rolled, and cold-rolled at a reduction rate of about 80% to provide 1.0 mm thick steel sheet.

The chemical composition of the steel sheet thus prepared is shown in the following Table.

| Carbon | Silicon | Manganese | Phosphorus | Sulfur | Aluminum | Nitrogen | Oxygen |
|---|---|---|---|---|---|---|---|
| 0.032% | 0.014% | 0.21% | 0.002% | 0.002% | 0.002% | 0.0014% | 0.0051% |

Test pieces of 0.8 mm(thickness)×30 mm(width)×50mm(length) were cut out from the steel sheet, degreased and chemically polished with a solution of 3% $HF+H_2O_2$. The test piece surfaces were thoroughly washed with alcohol and dried.

Referring to FIGS. 1A, 1B and 2A, 2B, two kinds of electrolyte baths were used; namely, electrolyte baths of $Al_2(SO_4)_3.18H_2O$ and $Na_2S_2O_3.5H_2O$. The two compounds were dissolved in redistilled water to concentrations of 0.00001 mol/l, 0.00005 mol/l 0.0001 mol/l, 0.001 mol/l, and 0.01 mol/l. "Redistilled water" was prepared by redistilling "distilled water".

Test pieces were electrolytically treated in the electrolyte baths at 80° C using the counter electrode made of stainless steel plate. Electric current densities were 0.15 A/dm²and 1.5 A/dm², and the time of electrolysis was 10 seconds. Each of the test pieces was used in three different manners; namely, as an anode, as a cathode, and alternately as an anode and as a cathode. Immediately after the electrolytic treatment, test pieces were washed with the redistilled water and dried by hot air.

When being treated alternatively as anode and as cathode, each test piece acted 11 times as anode and 10 times as cathode during the 10 seconds period for the electrolysis.

Reference test pieces were dipped into the electrolytic baths at 80° C for 10 seconds, without electric current. After being removed from the electrolyte baths, the reference test pieces were washed with the redistilled water and dried with hot air.

The test pieces which were treated by the same electrolytic condition were bound together so as to keep the test pieces in tight contact with each other. All the test pieces, including the reference test pieces and the electrolytically treated test pieces, were subjected to recrystallization annealing at 700° C for 6 hours in an atmosphere consisting of 7% of hydrogen and the remainder of nitrogen.

After the annealing, the binding of the test pieces was released, and X-ray diffraction test was made on 15×15 mm² area of the surface to which the adjacent test piece has been contacted during the recrystallization annealing, and the (002) peak intensity of graphite which is proportioned to the amount of graphite formed on the surface of the test piece was measured.

Figure 1A:
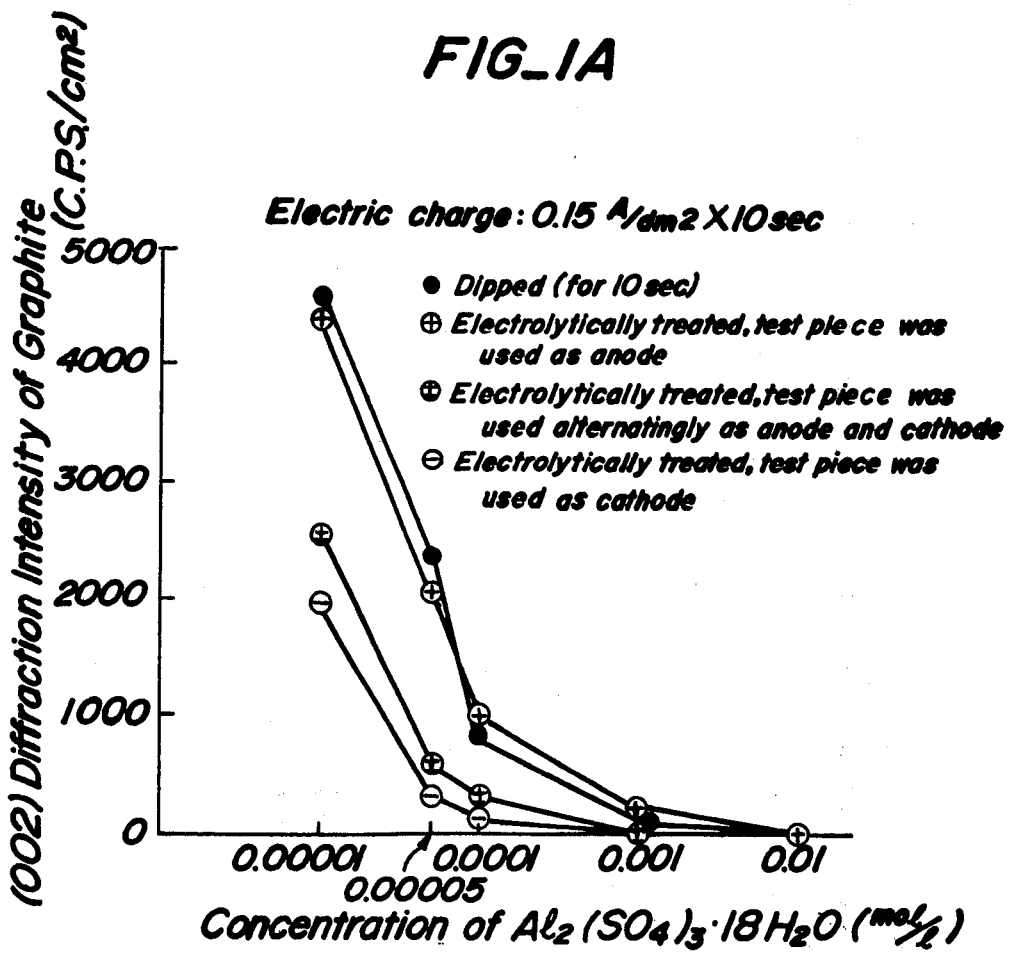
FIGS. 1A, 1B and FIGS. 2A, 2B illustrate the effect of electrolytic treatment prior to recrystallization annealing on the suppression of graphite formation for the cases of using electrolytes of aqueous solutions of $Al_2(SO_4)_3.18H_2O$ and $Na_2S_2O_3.5H_2O$.
Figure 1B:
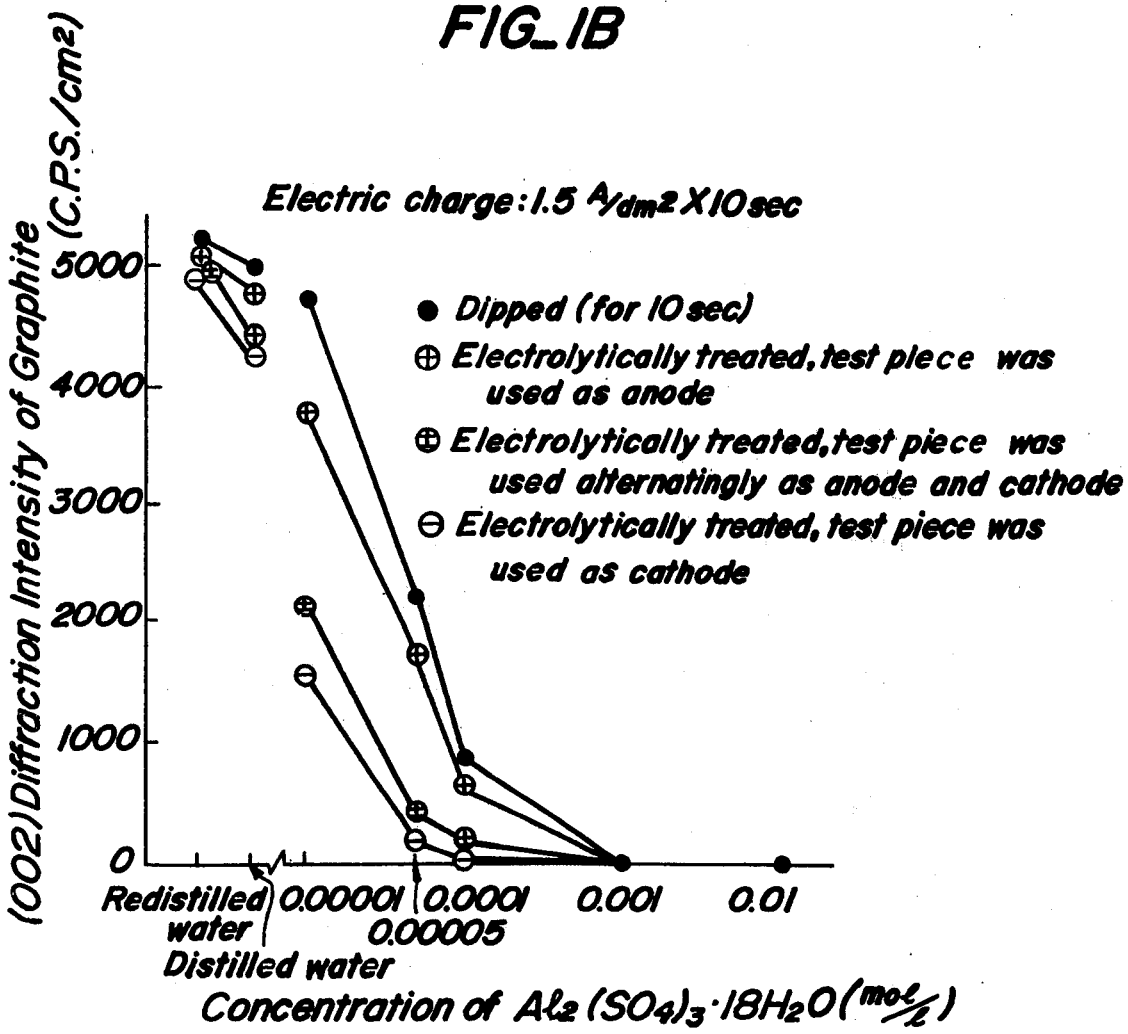
Figure 2A:
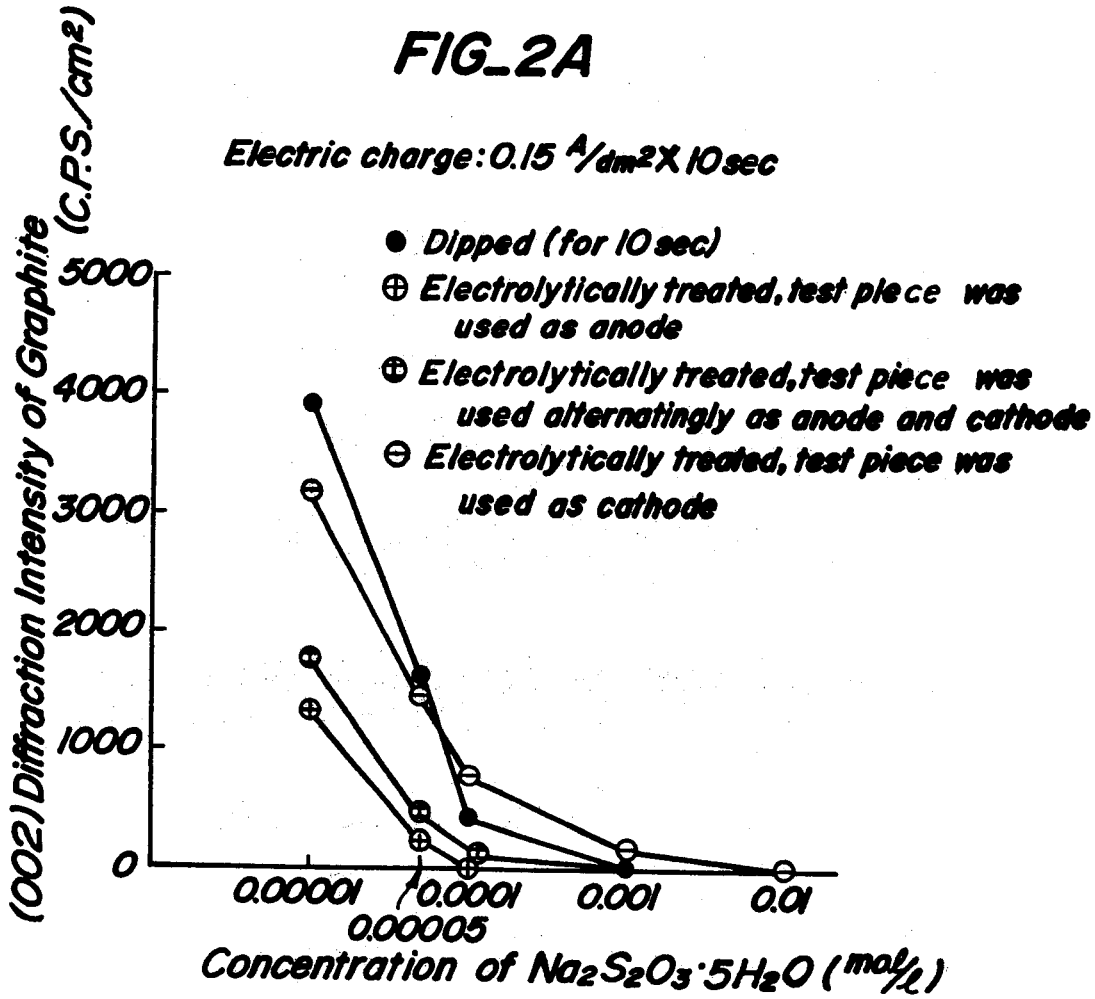
Figure 2B:
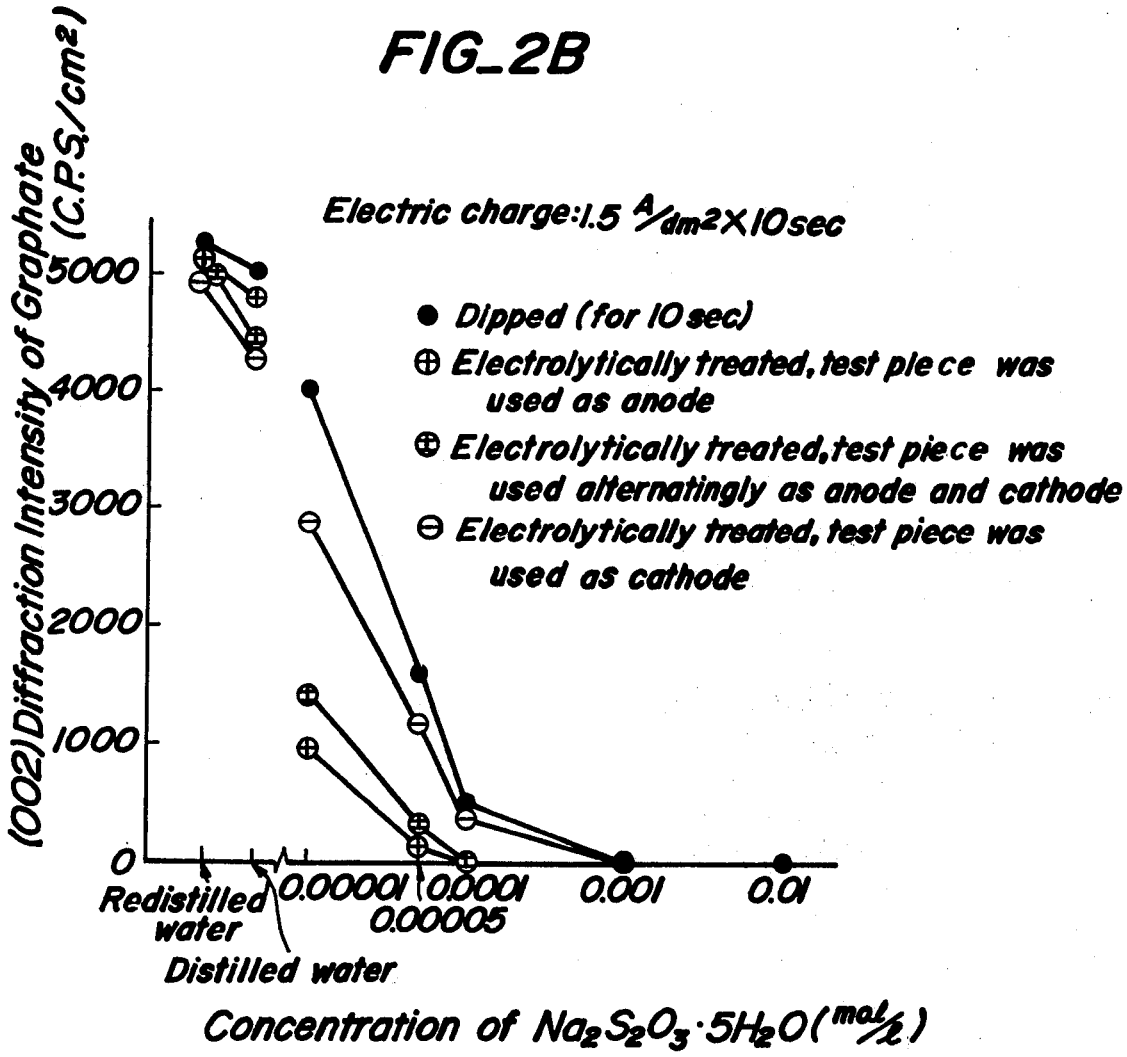

FIGS. 1A, 1B and 2A, 2B show the degree of suppressing the graphite formation on steel sheet test pieces during the recrystallization annealing, for different electrolytic treatments at different concentrations of $Al_2(SO_4)_3$ and $Na_2S_2O_3$. FIGS. 1B and 2B show a good reproducibility of the results as seen in the data on the specimens treated in the distilled water or the redistilled water.

As shown in FIGS. 1A, 1B, and FIGS. 2A, 2B, the graphite formation on steel sheet surfaces can be suppressed markedly by electrolytically treating the test piece as a cathode in the $Al_2(SO_4)_3$ electrolyte bath, or by electrolytically treating the test piece as an anode in the $Na_2S_2O_3$ electrolyte bath. Electrolytic treatment using the test piece alternatively as anode and as cathode, also results in a high level of suppresssing the graphite formation on steel sheet surfaces.

In the case of the electrolytic treatment using the test piece alternately as anode and as cathode, it has been confirmed that the last polarity of the test piece does not have any significant bearing on the effect of the electrolytic treatment.

Both of the electrolytic compounds used in the tests, i.e., $Al_2(SO_4)_3$ and $Na_2S_2O_3$, include sulfur as an ingredient element thereof. The fact that the anodic treatment with the $Al_2(SO_4)_3$ electrolyte and cathodic treatment with the $Na_2S_2O_3$electrolyte give good suppression of the graphite formation on the steel sheet surfaces suggests that, in the cases of $Al_2(SO_4)_3$ and $Na_2S_2O_3$ electrolytes, aluminum and sulfur are adsorbed, respectively, to the steel sheet surfaces and both elements suppress the graphite formation thereon.

In the cases of using high-purity distilled water and of using the purer redistilled water as the electrolytes, noticeable suppression of the graphite formation on the steel sheet surfaces cannot be achieved, as clearly shown in FIGS. 1A, 1B and FIGS. 2A, 2B.

Similar tests were made on the same steel test pieces as the preceding tests, by using the same pretreatments and electrolytic conditions, except that the electrolytes were replaced with $S_2Cl_2$ (0.00005 mol/l), $SbCl_3$ (0.000005 mol/l), $SeOCl_2$ (0.000005 mol/l), $Na_2SeO_3$ (0.000005 mol/l), $TeCl_4$ (0.000005 mol/l), and $Na_2TeO_3$ (0.000005 mol/l). The electrolytes were dissolved or suspended in the redistilled water, and the test pieces were used both as anode and as cathode.

Reference test pieces were made, which were merely dipped in the electrolyte baths at 80° C without electrolysis thereon. The reference test pieces were thoroughly washed with the redistilled water immediately after removing them from the electrolyte baths.

The test pieces which were treated by the same electrolytic condition were bound together so as to keep adjacent test pieces in tight contact with each other. All the test pieces, including the reference test pieces and the electrolytically treated test pieces, were subjected to recrystallization annealing at 700° C for 6 hours in an atmosphere consisting of 7% of hydrogen and the remainder of nitrogen.

After the annealing, the binding of the test pieces was released, and X-ray diffraction tests were made on the annealed test pieces. Theresults are shown in Table 8.

Table 8

Suppression of graphite formation by electrolysis in aqueous solutions or suspensions of compounds containing sulfur, antimony, selenium, or tellurium.

| Compound | Concentration (mol/l) | (002) diffraction intensity (CPS/cm²) of graphite: When dipped | Amount of electric charge (current density) × (time) (A/dm²) × (sec) | When treated by anodic electrolysis | When treated by cathodic electrolysis |
|---|---|---|---|---|---|
| $S_2Cl_2$ | 0.00005 | 2,440 | 0.15 × 10 | 220 | 1,730 |
| $SbCl_3$ | 0.000005 | 2,840 | " | 2,220 | 440 |
| $SeOCl_2$ | " | 2,620 | " | 400 | 2,400 |
| $Na_2SeO_3$ | " | 3,910 | " | 670 | 3,470 |
| $TeCl_4$ | " | 2,840 | " | 2,580 | 1,070 |
| $Na_2TeO_3$ | " | 2,310 | " | 360 | 3,000 |

As shown in Table 8, in comparison with the test pieces merely dipped, a marked improvement in the suppression of the graphite formation on the steel sheet surfaces can be achieved, either by applying electrolytic treatment in an electrolyte of $SeCl_2$, $SeOCl_2$, $Na_2SeO_3$ or $Na_2TeO_3$ using the test piece as anode, or by applying electrolytic treatment in an electrolyte of $SbCl_3$ or $TeCl_4$ using the test piece as cathode.

FIGS. 1A, 1B and FIGS. 2A and 2B also indicate that, even when electrolytes contain a common element therein, the degree of suppressing the graphite formation on steel sheet surfaces varies, depending on whether the steel sheet is treated as an anode or as a cathode.

Similar tests werer made on the suppression of the nitrogenization of steel sheets during the recrystallization annealing.

Commercial cold-rolled low-carbon aluminum-killed steel sheet (0.8 mm thick) ready for recrystallization treatment, which has a chemical composition shown in the following Table was prepared.

| Carbon | Silicon | Manganese | Phosphorus | Sulfur | Aluminum | Nitrogen |
|---|---|---|---|---|---|---|
| 0.041% | 0.009% | 0.31% | 0.008% | 0.014% | 0.045% | 0.006% |

Test pieces of 0.8 mm(thickness)×30 mm(width)×50 mm(length) were cut out from the steel sheet, and after degreasing, each test piece was chemically polished with a solution of 3% $HF+H_2O_2$. The test piece surfaces were thoroughly washed with alcohol and dried.

Figure 4:
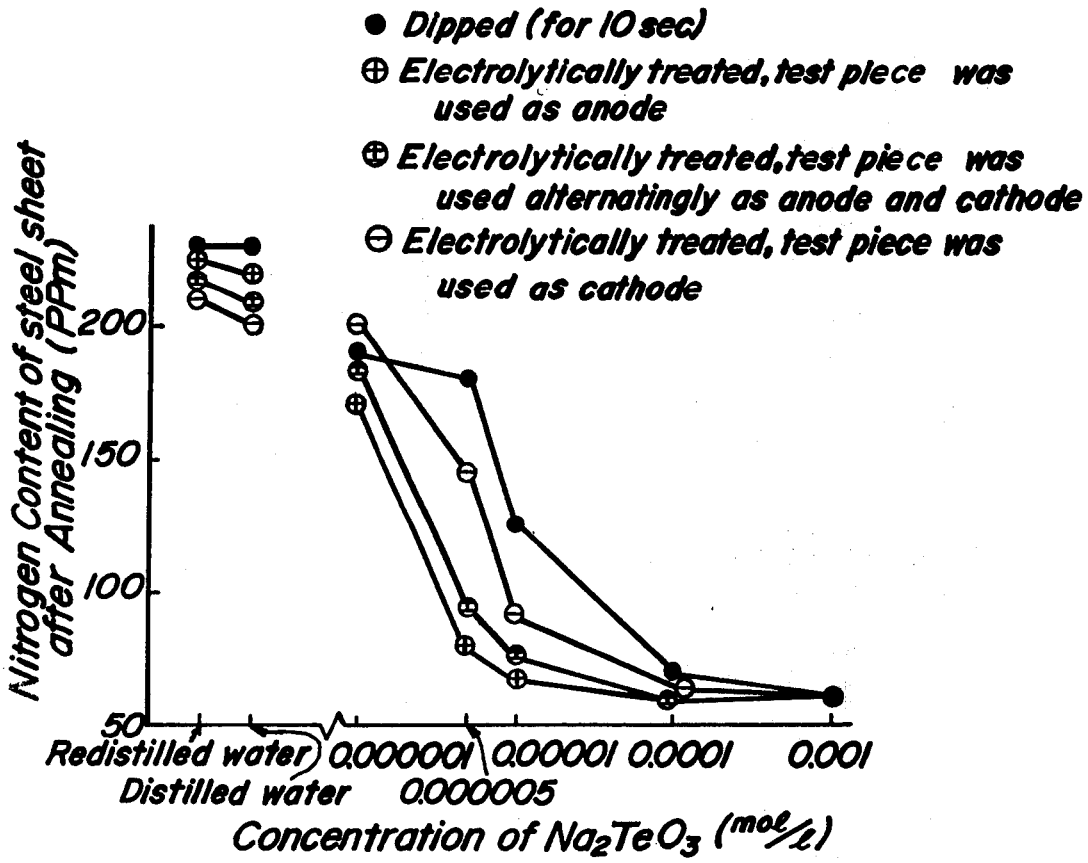
FIG. 4 illustrates the effect of electrolytic treatment applied to steel sheet on the suppression of nitrogenization for the case of using electrolyte of aqueous solution of $Na_2TeO_3$.

Referring to FIG. 4, $Na_2TeO_3$ was dissolved in "redistilled water" to provide electrolytic baths whose concentrations of $Na_2TeO_3$ ranged from 0.000001 mol/l to 0.001 mol/l.

Each test piece was electrolytically treated for 10 seconds in the electrolyte baths at 80° C with an electric current density of 1.0 A/dm². Each of the test pieces was used in three different manners namely, as an anode, as a cathode, and alternately as an anode and as a cathode. Immediately after the electrolytic treatment, each test piece was washed with the redistilled water and dried by hot air.

When being treated alternately as anode and as cathode, each test piece acted 10 times as anode and 9 times as cathode during the 10 seconds period for the electrolysis.

Reference test pieces were dipped into the electrolytic baths at 80° C for 10 seconds without electric current. After being removed from the electrolyte baths, the reference test pieces were washed with the redistilled water and dried with hot air.

Three test pieces which were treated by the same electrolytic condition were bound together so as to keep the adjacent test pieces in tight contact with each other. All the test pieces, including the reference test pieces and the electrolytically treated test pieces, were subjected to recrystallization annealing at 700° C for 6 hours in an atmosphere consisting of 7% of hydrogen and the remainder of nitrogen.

For each the three test pieces which were bound together, the total nitrogen content for full-thickness-sample of the midmost test piece in the three test pieces after the annealing was measured. The results are shown in FIG. 4.

The electrolytic treatment with the distilled water alone or the redistilled water alone did not produce any effect of suppressing the nitrogenization during the recrystallization annealing. On the other hand, the electrolytic treatment especially with the electrolyte bath having an $Na_2TeO_3$ concentration of which was 0.000005 mol/l or larger, a noticeable suppression of the nitrogenization during the recrystallization annealing was achieved. As compared with the case of simple dipping, the application of the electrolytic treatment using the test pieces in any of the aforesaid three manners produced a better suppression of the nitrogenization, provided that the concentrations of the compounds in the electrolyte baths were the same for both the simple dipping and the electrolytic treatment. It was also confirmed that the last polarity of the test pieces in the electrolytic treatment using the test pieces alternately as anodes and as cathodes, does not have any significant bearing on the final effect of suppressing the nitrogenization during the recrystallization annealing.

Referring to FIG. 5, anodic electrolytic treatments and cathodic electrolytic treatments were carried out with other electrolytes on test pieces similar to those of the preceding tests. The pretreatments on the test pieces and the electrolytic conditions were the same as those of the preceding tests. The electrolyte baths were aqueous solutions each containing one of $NaAlO_2$, $SnCl_2.2H_2O$, and $KH_2AsO_4$ at a concentration of 0.00005 mol/l, and aqueous solutions or suspensions each containing one of $PbCl_2$, $SbCl_3$, $BiCl_3$, $Na_2SeO_3$, and $TeCl_4$ at a concentration of 0.000005 mol/l. (All the aqueous solutions and suspensions were made by using the redistilled water.)

Reference test pieces were treated simply by dipping them in the electrolyte baths at 80° C for 10 seconds, and immediately after removing from the baths, they were washed with the redistilled water and dried.

Each three test pieces which were treated by the same electrolytic condition were bound together so as to keep the adjacent test pieces in tight contact with each other. All the test pieces, including the reference test pieces and the electrolytically treated test pieces, were subjected to recrystallization annealing at 700° C for 20 hours in an atmosphere consisting of 7% of hydrogen and the remainder of nitrogen. After the annealing, the total nitrogen contents of test pieces were measured by chemical analysis. The results of such measurement are shown in FIG. 5.

As shown in FIG. 5, in comparison with the test pieces merely dipped, a considerably higher suppression of the nitrogenization during the recrystallization annealing was achieved by anodic treatment for the aqueous solutions of $NaAlO_2$, $KH_2AsO_4$, and $Na_2SeO_3$, and by cathodic treatment for the aqueous solutions or suspensions of $SnCl_2$, $PbCl_2$, $SbCl_3$, $BiCl_3$, and $TeCl_4$. It was also confirmed that, for aqueous solutions of compounds having a common element, the effect of suppressing the nitrogenization varies depending on whether the anodic or cathodic treatment should be properly selected depending on the kind of the compound.

As a results of the above mentioned tests on aqueous solutions and suspensions of different compounds, the following compounds (inclusive of compounds having water of crystallization) were found to have reliable effect when used in the form of aqueous solutions or suspensions.

1. Compounds containing sulfur: $K_2S$, $Na_2S_2O_3$, $K_2S_2O_3$, $Na_2S$, $FeSO_4$, $KHSO_4$, $NaHSO_3$, $S_2Cl_2$, $H_2SO_4$, $Al_2(SO_4)_3$, $K_2SO_4$, $FeSO_4.(NH_4)_2SO_4$, $CrSO_4$, $K_2S_2O_7$, $K_2S_2O_8$, $Na_2S_2O_7$, $Na_2S_2O_8$, $Na_2SO_3$, $(NH_4)_2SO_4$, $NH_4HSO_3$, $(NH_4)_2S_2O_8$, $NH_4OSO_2NH_2$, $Na_2SO_4$, $ZnSO_4$, $Ti(SO_4)_2$.
2. Compounds containing aluminum: $Al_2(SO_4)_3$, $NaAlO_2$, $AlCl_3$, $Al(NO_3)_3$.
3. Compounds containing tin: $SnCl_2$, $Sn(NO_3)_4$, $SnI_2$.
4. Compounds containing arsenic: $As_2S_3$, $NaAsO_2$, $H_3AsO_4$, $KH_2AsO_4$, $Na_2HAsO_3$, $(NH_4)_3AsO_4$, $AsCl_3$, $As_2O_3$, $K_3AsO_3$.
5. Compounds containing lead: $PbCl_2$, $Pb_2O(OH)_2$, $Pb(NO_3)_2$, $Pb(CH_3COO)_2$.
6. Compounds containing antimony: $SbCl_3$, $SbBr_3$, $SbOCl$, $Sb_2(SO_4)_3$, $Sb_2O_3$.
7. Compounds containing bismuth: $NaBiO_3$, $BiCl_3$, $Bi_2(SO_4)_3$, $Bi(NO_3)_3$.
8. Compounds containing selenium: $H_2SeO_3$. $Se_2Cl_2$, $SeOCl_2$, $SeS_2$, $H_2SeO_4$, $SeO_2$, $K_2Se$, $Na_2Se$, $K_2SeO_3$, $K_2SeO_4$, $Na_2SeO_3$, $Na_2SeO_4$.
9. Compounds containing telluriun. $H_2TeO_4$, $K_2TeO_3$, $K_2TeO_4$, $Na_2TeO_3$, $Na_2TeO_4$, $TeCl_4$.

Figure 3A:
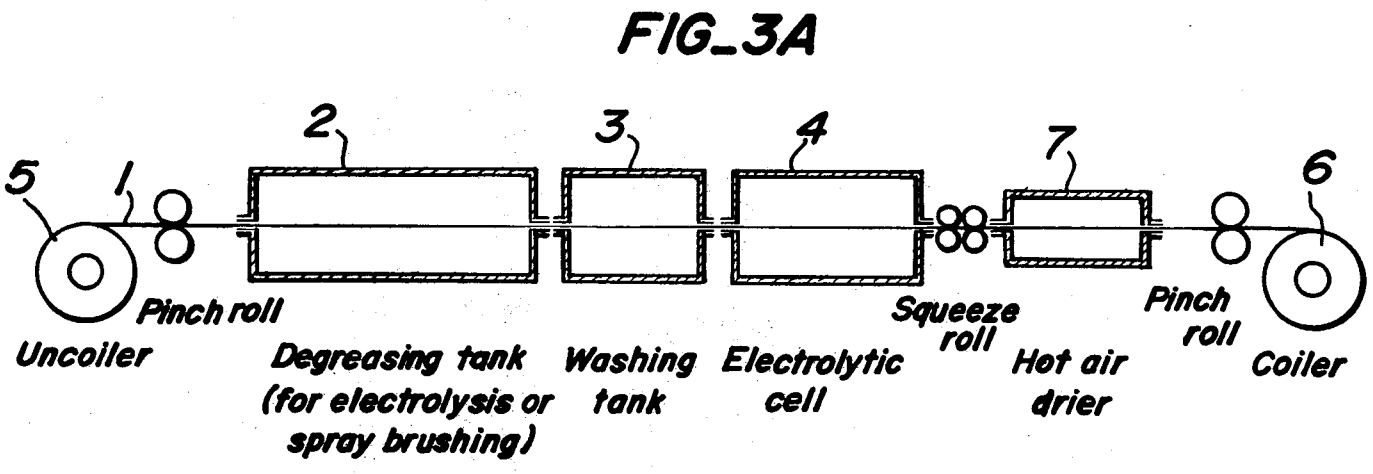
FIGS. 3A and 3B show two processes, according to the present invention.
Figure 3B:
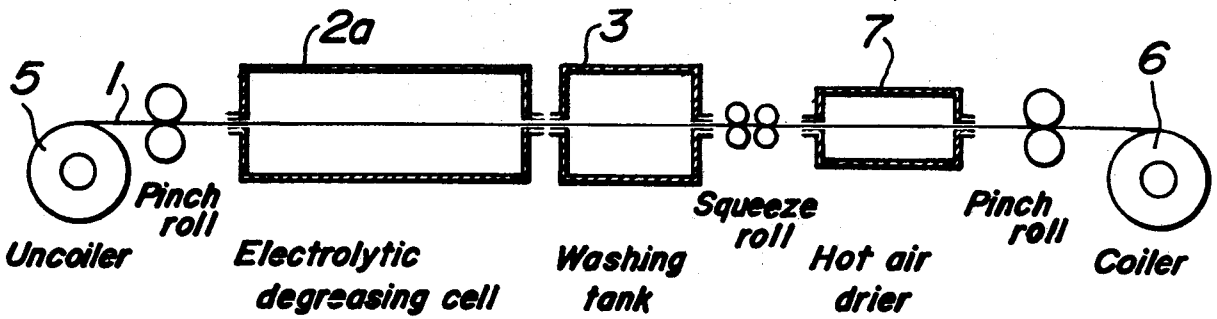

FIGS. 3A and 3B schematically show the manners in which the electrolytic treatment of the invention is effected on steel sheets. With the method of FIG. 3A, steel sheet 1 is degreased in a degressing tank 2, either by electrolysis or by brushing combined with spraying (spray-brush method), washed with water in a washing tank 3, and then treated in an electrolytic cell 4 containing a dilute solution of one or more compounds having sulfur, aluminum, tin, arsenic, lead, antimony, bismuth, selenium, and/or tellurium. The cell 4 is to effect the electrolytic treatment of the invention. On the other hand, with the method of FIG. 3B, one or more of the aforesaid compounds usable in the method of FIG. 3A, are added in an electrolytic degreasing cell **2*a*, so as to simultaneously effect the degreasing and the electrolytic treatment of the invention on the steel sheet 1. In FIGS. 3A and 3B, the steel sheet 1 is treated while it is transferred from an uncoiler 5 toward a coiler 6, and residual liquid on the surface of the steel sheet 1 can be removed by a hot air drier 7 before the steel sheet 1 is taken up by the coiler 6.**

If a separate electrolytic cell 4 is used for the electrolytic treatment of the invention, as shown in FIG. 3A, the cell may include a plurality of counter electrodes (not shown) which are disposed on the opposite sides of the steel sheet 1 being fed through the cell 4. Such counter electrodes may be energized in alternately different polarities, for instance, every other electrodes are given positive voltage while giving negative voltage to the other counter electrodes, so as to cause the steel sheet to be treated alternately as anode and cathode. Such alternate arrangement is advantageous to ensure a stable effect of suppressing both the graphite formation on the steel sheet surface and the nitrogenization of the steel sheet during the recrystallization annealing, substantially independently of the type of electrolyte used in the cell 4. The invention is, of course, not limited to such arrangement of the electrolytic cell 4.

With the treatment at the electrolytic cell 4 or at the electrolytic degreasing cell 2*a*, the element or elements contained in the compound added in the cell 4 or 2*a* are firmly adsorbed onto the surfaces of the steel sheet 1 by electrochemical reaction. Whereby, a high level of suppression of the graphite formation and nitrogenization can be achieved during the recrystallization annealing.

The absolute amount of the compound or compounds to be adsorbed to the steel sheet surface for achieving the desired suppression is so small that any accurate definition of such absolute amount is hardly possible, but the amount of the electric charge (coulombs) to be applied to the steel sheet 1 during the electrolytic treatment can be used as an indirect parameter for limiting such amount of the compound or compounds to be adsorbed onto the steel sheet surface. More particularly, the desired suppression of the graphite formation and nitrogenization can be achieved by using an electric charge of 1 to 20 coulombs/dm$^2$ in the electrolytic treatment of the invention. If the charge is less than 1 coulomb/dm$^2$, the desired suppression cannot be achieved. On the other hand, if the charge exceeds 20 coulomb/dm$^2$, power source for the electrolytic treatment may become unreasonably large or a long treating time may be required. To provide the long treating time, it will be necessary to use a long cell or a slow feeding of the steel sheet, both of which tend to increase installation and production costs.

As shown from the foregoing test results, there is a certain minimum level of the concentration of the compounds in the electrolytic bath for each of the compounds, because too dilute electrolytic bath does not produce satisfactory suppression of the graphite formation and the nitrogenization. The concentration of the compounds must not exceed 0.001 mol/l, because the use of the compounds in excess of 0.001 mol/l causes a cost rise but does not improve the suppression of the graphite formation and the nitrogenization.

EXAMPLE 4

Commercial low-carbon steel was melted by a 200-ton converter for making ingots, rolled to slabs, hot-rolled to coils, pickled, and cold-rolled (at a reduction ratio of 70%) in conventional fashion.

The ladle analysis of the ingot is shown in the following Table.

| Carbon | Manganese | Phosphorus | Sulfur |
|---|---|---|---|
| 0.05%-0.06% | 0.28%-0.35% | 0.007%-0.01% | 0.015%-0.020% |

Seven steel sheet coils, No. 1 to No. 7 in Table 9, were prepared by degreasing through the conventional spraybrush tank, washing with water, and electrolytically treating in a separate electrolytic cell under the following conditions. Five coils, i.e., No. 1 to No. 5, were treated with aqueous solutions or suspensions, each containing one of $Na_2S_2O_3.5H_2O$, $Al_2(SO_4)_3.18H_2O$, $SbCl_3$, $Na_2TeO_3$, and $PbCl_2$. Two coils, i.e., No. 6 and No. 7, were covered with the two mixtures as shown in Table 9. The two mixtures were those of $SbCl_3$ plus $Al_2(SO_4)_3.18H_2O$; and $K_2TeO_3$ plus $Na_2S_2O_3.5H_2O$. The concentrations of the compounds were adjusted to the levels of Table 9, by adding water from city water supply. The test coils were fed through electrolytic baths, consisting of the aforesaid aqueous solutions or suspensions, at a rate of 400 m/min with an electric charge of 6 coulombs/dm$^2$. After the electrolytic treatments, the test coils were dried with hot air, and they were subjected to the recrystallization annealing in the tightly coiled condition.

Test pieces of three coils in Table 9, i.e., coils No. 8 to No. 10 were electrolytically degreased, by using three electrolytic baths, each consisting of 3% aqueous solution of sodium orthosilicate plus one of $Na_2SeO_3$, $Na_2SO_4$, and $Na_2TeO_3$, and by feeding the test coils at 400 m/min with an electric charge of 12 coulombs/dm$^2$. After the degreasing, the test pieces were dried with hot air, and then subjected to the recrystallization annealing in the same manner as the coils No. 1 to No. 7. Table 9 shows the rejection rate of the test pieces due to the graphite formation on the steel sheet surfaces.

For the purpose of comparison, Table 9 also shows reference coils No. 11 to No. 16 which were degreased but not treated by the method of the invention, namely, the coils No. 11 to No. 13 were merely degreased in an electrolytic tank, while the coils No. 14 to No. 16 were merely degreased by the conventional spray-brush method. The reference coils were also subjected to the same recrystallization annealing in the same manner as the coils No. 1 to No. 10, and their rejection rates are also shown in Table 9.

Suppression of graphite formation by electrolysis in aqueous solutions or suspensions of compounds containing sulfur, aluminum, antimony, lead, or tellurium.

| Treating Conditions | Compound added No. | Compound added Composition | Concentration (mol/l) | Amount of electric charge (current density) × (time) (A/dm$^2$) × (sec) | Rejection rate (%), due to graphite formation |
|---|---|---|---|---|---|
| | 1 | $Na_2S_2O_3 . 5H_2O$ | 0.0001 | 2 × 3 | 0 |
| | 2 | $Al_2(SO_4)_3 . 18H_2O$ | " | " | 1.0 |
| | 3 | $SbCl_3$ | 0.00005 | " | 0.2 |
| Electrolytically treated after degreasing by | 4 | $Na_2TeO_3$ | " | " | 0 |
| | 5 | $PbCl_2$ | " | " | 0.8 |

-continued

| Treating Conditions | Suppression of graphite formation by electrolysis in aqueous solutions or suspensions of compounds containing sulfur, aluminum, antimony, lead, or tellurium. Compound added No. | Composition | Concentration (mol/l) | Amount of electric charge (current density) × (time) (A/dm²) × (sec) | Rejection rate (%), due to graphite formation |
|---|---|---|---|---|---|
| spray brushing | 6 | $SbCl_3$ | 0.000005 | " | .0 |
| | | $Al_2(SO_4)_3 . 18H_2O$ | " | | |
| | | $K_2TeO_3$ | " | | |
| | 7 | $Na_2S_2O_3 . 5H_2O$ | " | | " |
| Added compound in liquid during electrolytic degreasing | 8 | $Na_2S_2O_3 . 5H_2O$ | 0.0001 | 4 × 3 | 0.9 |
| | 9 | $Na_2SO_4 . 10H_2O$ | " | " | 1.5 |
| | 10 | $Na_2TeO_3$ | 0.00005 | " | 0.7 |
| Electrolytically degreased (without addding compound) | 11 | Not added | — | " | 7.8 |
| | 12 | " | — | " | 15.3 |
| | 13 | " | — | " | 9.4 |
| Degreased by spray brushing (without adding compound) | 14 | " | — | — | 15.7 |
| | 15 | " | — | — | 12.5 |
| | 16 | " | — | — | 35.1 |

As shown from Table 9, steel sheets which are treated by the method of the present invention are substantially free from surface defects due to the graphite formation thereon. The effect of the method of the present invention is proved to be stable.

Example 5

Commercial aluminum killed steel and silicon steel were melted by a converter for making ingots, and rolled to slabs, hot-rolled to coils, pickled, and cold-rolled in a conventional fashion.

The ladle analysis of the aluminum killed steel and silicon steel are shown in the following Tables in addition to aluminum and nitrogen contents shown in Table 10.

| Aluminum | Carbon | Manganese | Phosphorus | Sulfur |
|---|---|---|---|---|
| killed steel | 0.02%–0.05% | 0.30%–0.35% | 0.007%–0.01% | 0.015%–0.02% |

| | Carbon | Silicon | Manganese | Phosphorus | Sulfur |
|---|---|---|---|---|---|
| Silicon steel | 0.01%–0.02% | 1.35%–1.50% | 0.15%–0.20% | 0.007%–0.01% | 0.01%–0.012% |

As shown in Table 10, aluminum killed steel coils No. 1 to No. 7 and silicon steel coils No. 8 and No. 9 were degreased and cleansed by the conventional spray-brush method, and were electrolytically treated under the following conditions.

Electrolyte baths:Aqueous solutions or suspensions, each containing one of $Al_2(SO_4)_3.18H_2O$, $Sn_2Cl_2$, $SbCl_3$, $Na_2SeO_3$, and $Na_2TeO_3$; or mixed baths, containing $Al_2(SO_4)_3.18H_2O$ plus $SbCl_3$; or $Al_2(SO_4)_3.18H_2O$ plus $Na_2TeO_3$.

Sheet feeding speed: 400 m/min

Electric current:2 A/dm² for 3 seconds

After the electrolytic treatments, the coils were dried with hot air, and then subjected to the recrystallization annealing at 700° C for 35 hours in the HNX gas atmosphere in the tightly coiled condition.

Four coils, i.e., aluminum killed steel coils No. 10 to No. 12 and a silicon steel coil No. 13, were electrolytically treated during degreasing by the method of the invention, and one of $Al_2(SO_4)_3.18H_2O$, $NaAlO_2$, and $Na_2TeO_3$ was added in the four degreasing baths. The feeding speed of coils were 400 m/min, and the electrolytic condition was 4 A/dm² for 3 seconds. After drying with hot air, those four coils were also annealed in the tightly coiled condition in the same manner as the coils No. 1 to No. 9.

The variations of the nitrogen contents in the steel sheets before and after the recrystallization annealing were measured. The results are shown in Table 10.

Referring to Table 10, seven reference coils No. 14 to No. 20 were degreased but not treated by the method of the present invention: namely, the three reference coils No. 14 to No. 16 were electrolytically degreased without adding any special compounds in the degreasing baths, and the four reference coils No. 17 to No. 20 were degreased by the conventional spray-brush method. All the reference coils were annealed for recrystallization, and their nitrogen contents were measured before and after the annealing, as shown in Table 10.

| Treating conditions | Specimen No. | Type of steel | Compound added | Concentration (mol/l) | Amount of electric charge (current density) × (time) (A/dm²) × (sec) | Aluminum (Wt. %) | Nitrogen (Wt. %) Before annealing | After annealing |
|---|---|---|---|---|---|---|---|---|
| Electrolytically treated after degreasing by spray brushing | 1 | Aluminum-killed steel | $Al_2(SO_4)_3 . 18H_2O$ | 0.0001 | 2 × 3 | 0.029 | 0.0053 | 0.0090 |
| | 2 | " | $SnCl_2$ . | " | " | 0.055 | 0.0060 | 0.0085 |
| | 3 | " | $SbCl_3$ | " | " | 0.040 | 0.0058 | 0.0065 |
| | 4 | " | $Na_2SeO_3$ | " | " | 0.036 | 0.0055 | 0.0070 |
| | 5 | " | $Na_2TeO_3$ | " | " | 0.038 | 0.0048 | 0.0055 |
| | 6 | " | $Al_2(SO_4)_3 . 18H_2O$ | 0.00005 | " | 0.043 | 0.0056 | 0.0065 |
| | | | $SbCl_3$ | 0.00005 | | | | |
| | 7 | " | $Al_2(SO_4)_3 . 18H_2O$ | 0.00005 | " | 0.035 | 0.0051 | 0.0063 |

-continued

| Treating conditions | Specimen No. | Type of steel | Compound added | Concentration (mol/l) | Amount of electric charge (current density) × (time) (A/dm²) × (sec) | Aluminum (Wt. %) | Nitrogen (Wt. %) Before annealing | Nitrogen (Wt. %) After annealing |
|---|---|---|---|---|---|---|---|---|
| | 8 | Silicon steel | $Na_2TeO_3$<br>$Al_2(SO_4)_3 \cdot 18H_2O$ | 0.00005<br>0.0001 | " | 0.15 | 0.0063 | 0.0085 |
| | 9 | " | $Al_2(SO_4)_3 \cdot 18H_2O$<br>$Na_2TeO_3$ | 0.00005<br>0.00005 | " | 0.20 | 0.0060 | 0.0070 |
| Added compound in liquid during electrolytic degreasing | 10 | Aluminum-killed steel | $Al_2(SO_4)_3 \cdot 18H_2O$ | 0.0001 | 4 × 3 | 0.048 | 0.0055 | 0.0088 |
| | 11 | " | $NaAlO_2$ | " | " | 0.040 | 0.0050 | 0.0095 |
| | 12 | " | $Na_2TeO_3$ | " | " | 0.036 | 0.0053 | 0.0060 |
| | 13 | Silicon steel | $Na_2TeO_3$ | " | " | 0.17 | 0.0058 | 0.0065 |
| Electrolytically degreased (without adding compound) | 14 | Aluminum-killed steel | Not added | — | — | 0.035 | 0.0050 | 0.0145 |
| | 15 | " | " | — | " | 0.042 | 0.0056 | 0.0167 |
| | 16 | Silicon steel | " | — | " | 0.21 | 0.0055 | 0.323 |
| Degreased by spray brushing (without adding compound) | 17 | Aluminum-killed steel | " | — | " | 0.034 | 0.0058 | 0.0185 |
| | 18 | " | " | — | — | 0.043 | 0.0053 | 0.0190 |
| | 19 | " | " | — | — | 0.049 | 0.0050 | 0.0180 |
| | 20 | Silicon steel | " | — | — | 0.18 | 0.0062 | 0.0360 |

As shown in Table 10, the aluminum killed steel and silicon steel sheets, which are treated by the method according to the present invention are substantially free from the nitrogenization phenomenon during the recrystallization annealing.

Example 6

Commercial low-nitrogen rimmed steel was melted in a converter for making ingots, and rolled to slabs, hot-rolled, to coils, pickled, and cold-rolled in a conventional fashion.

Ladle analysis of the steel is shown in the following Table.

| Carbon | Manganese | Phosphorus | Sulfur |
|---|---|---|---|
| 0.05%–0.06% | 0.28%–0.35% | 0.007%–0.01% | 0.015%–0.02% |

Referring to Table 11, six coils No. 1 to No. 6 were degreased and cleansed by the conventional spray-brush method, and electrolytically treated under the following conditions.

Electrolyte baths:Aqueous solutions or suspensions, each containing one of $Al_2(SO_4)_3.18H_2O$, $SbCl_3$, $Na_2SeO_3$, and $Na_2TeO_3$; or two of the aforesaid compounds.

Sheet feeding speed: 400 m/min

Electric current:2 A/dm² for 3 seconds

After the electrolytic treatments, the coils were dried with hot air.

Three coils, i.e., the coils No. 7 to No. 9, were electrolytically treated during degreased, by adding one of $Al_2(SO_4)_3.18H_2O$, $SbCl_3$ and $Na_2TeO_3$ in the three degreasing baths. The coil feeding speed was 400 m/min and the electric condition was 4 A/dm² for 3 seconds. After the electrolytic treatments, the coils No. 7 to N0. 9 were also dried with hot air.

All the coils No. 1 to No. 9 were annealed for recrystallization at 700° C for 10 hours in the HNX gas atmosphere in the tightly coiled condition. The variations of the nitrogen contents before and after the annealing are shown in Table 11.

Table 11 also shows the results of similar tests without applying the electrolytic treatment of the invention, namely, three reference coils No. 10 to No. 12 were merely electrolytically degreased, and three reference coils No. 13 to No. 15 were merely degreased by the conventional spray-brush method. All the reference coils were similarly annealed for recrystallization, and their nitrogen contents are also shown in Table 11.

Suppression of nitrogenization of low-nitrogen rimmed cold-rolled steel sheet by electrolysis in aqueous solutions or suspensions containing aluminum, antimony, selenium, or tellurium.

| Treating conditions | Compound added No. | Compound added Composition | Concentration (mol/l) | Amount of electric charge (current density) × (time) (A/dm²) × (sec) | Nitrogen (Wt.%) Before annealing | Nitrogen (Wt.%) After annealing |
|---|---|---|---|---|---|---|
| Electrolytically treated after degreasing by spray brushing | 1 | $Al_2(SO_4)_3 \cdot 18H_2O$ | 0.0001 | 2 × 3 | 0.0013 | 0.0015 |
| | 2 | $SbCl_3$ | " | " | 0.0011 | 0.0012 |
| | 3 | $Na_2SeO_3$ | " | " | 0.0013 | 0.0013 |
| | 4 | $Na_2TeO_3$ | " | " | 0.0010 | 0.0010 |
| | 5 | $Al_2(SO_4)_3 \cdot 1\ 8H_2O$<br>$SbCl_3$ | 0.00005<br>0.00005 | " | 0.0012 | 0.0014 |
| | 6 | $Al_2(SO_4)_3 \cdot 1\ 8H_2O$<br>$Na_2TeO_3$ | 0.00005<br>0.00005 | " | 0.0014 | 0.0015 |
| Added compound in liquid during electrolytic degreasing | 7 | $Al_2(SO_4)_3 \cdot 1\ 8H_2O$ | 0.0001 | 4 × 3 | 0.0012 | 0.0015 |
| | 8 | $SbCl_3$ | " | " | 0.0010 | 0.0012 |
| | 9 | $Na_2TeO_3$ | " | " | 0.0013 | 0.0013 |
| | 10 | Not added | — | " | 0.0010 | 0.0018 |
| Electrolytically | | | | | | |

-continued

| Suppression of nitrogenization of low-nitrogen rimmed cold-rolled steel sheet by electrolysis in aqueous solutions or suspensions containing aluminum, antimony, selenium, or tellurium. | | | | | | |
|---|---|---|---|---|---|---|
| Treating conditions | Compound added No. | Compound added Composition | Concentration (mol/l) | Amount of electric charge (current density) × (time) (A/dm²) × (sec) | Nitrogen (Wt.%) Before annealing | Nitrogen (Wt.%) After annealing |
| degreased (without adding compound) | 11 | " | — | " | 0.0013 | 0.0021 |
| | 12 | " | — | " | 0.0015 | 0.0019 |
| | 13 | " | — | — | 0.0012 | 0.0019 |
| Degreased by spray brushing (without adding compound) | 14 | " | — | — | 0.0013 | 0.0021 |
| | 15 | " | — | — | 0.0016 | 0.0021 |

As shown from Table 11, cold-rolled low-nitrogen rimmed steel sheet which is treated by the method of the present invention is free from the nitrogenization during the recrystallization annealing.

The elements for suppressing the nitrogenization of steel sheets during the recrystallization annealing can be added in the steel itself, too. More particularly, according to the present invention, there is provided cold-rolled steel sheet containing at least one element selected from the group consisting of 0.001 to 0.5% by weight of aluminum, titanium, niobium, vanadium, zirconium, and boron and 0.05 to 3.25% by weight of silicon, characterized in that said steel sheet contains at least one element selected from the group consisting of 0.002 to 0.2% by weight of tellurium, selenium, bismuth, and antimony and 0.01 to 0.2% by weight of lead, tin, and arsenic, whereby the steel sheet is free from nitrogenization during recrystallization annealing. The aforesaid steel sheet of the invention may be a cold-rolled rimmed steel sheet containing less than 0.002% by weight of nitrogen. The element or elements for preventing the nitrogenization may be added during the process of making iron or steel.

The inventors have carried out many tests for finding out that the nitrogenization during the recystallization annealing can be suppressed by adding certain element or elements in the steel sheet, as will be described hereinafter.

Commercial steel containing 0.04 of carbon, 0.01% of silicon, 0.30 of manganese, 0.08% of phosphorus, 0.014% of sulfur, 0.04% of aluminum, and 0.006% of nitrogen was melted in an experimental metling furnace, and ingots were made after adding up to 0.2% of one element of tellurium, selenium, bismuth, antimony, lead, tin, and arsenic at different concentrations.

Each of the ingots thus made was forged, hot-rolled pickled, and cold-rolled into 0.8 mm thick cold-rolled sheet. Test pieces of 30 mm by 50 mm were cut out from the steel sheet thus cold-rolled. After thoroughly degreasing and cleansing, the test pieces were overlaid one on the other and compressed by a press machine so as to substantially eliminate gaps between adjacent test pieces. The test pieces were suitably bound together during the compressing.

Two sets of the bound test pieces were prepared for each kind of the steels. One set from each kind of the steels was annealed in the experimental furnace at 700° C for 20 hours in an atmosphere consisting of 7% of hydrogen and the remainder of nitrogen. Another set of the test piece for each kind of steels was annealed in a factory furnace of bell type together with aluminum killed cold-rolled steel coil in the HNX gas atmosphere.

After the annealing, the total nitrogen contents of the full-thickness-samples of the individual test pieces were measured by chemical analysis, and the mean values of the total nitrogen contents thus measured were determined for each set of the test pieces.

There was no significant differences of the nitrogen contents between those test pieces which were annealed in the experimental furnace and the corresponding test pieces annealed in the factory furnace of bell type.

The results of the chemical analysis, i.e., the variations of the nitrogen contents by the annealing, are shown in FIG. 6.

As shown in FIG. 6, in the case of reference test pieces, to which none of the aforesaid elements was added, the nitrogen content of about 0.006% before the annealing increased to about 0.022% after the annealing.

On the other hand, with test pieces having the aforesaid elements added therein, the increase of the nitrogen content during the annealing was greatly suppressed. When the elements in excess of certain minimum concentrations were added, the increase of the nitrogen content by the annealing was almost completely eliminated. Such effect of suppressing the nitrogenization, or nitrogen pick-up, is particularly remarkable when one of tellurium, selenium, bismuth, and antimony is added in the steel, as compared with the case of adding lead, tin, or arsenic. Since the suppression of the nitrogenization can be achieved by adding only extremely small amounts of the aforesaid elements, the mechanical and physical properties of the steels are not changed at all by such additions of the elements.

Judging from the results in FIG. 6, in order to achieve a substantially complete elimination of the nitrogenization by using only one element, the amount of the elements to be added in the steel must be more than the following minimums.

Tellurium, not less than 0.004%
Selenium, not less than 0.005%
Bismuth, not less than 0.009%
Antimony, not less than 0.01%
Lead, not less than 0.023%
Tin, not less than 0.037%
Arsenic, not less than 0.08%

If two or more elements from the afore-listed group are to be added, satisfactory nitrogenization suppression may be achieved even when the amount of each element added is less than the aforesaid minimums.

The composition of the steel to which the aforesaid elements may be added according to the method of the present invention is restricted to contain at least one element selected from the group consisting of 0.01 to 0.5% by weight of nitride former elements, i.e., aluminum, titanium, niobium, vanadium, zirconium, and boron, and 0.05 to 3.25% by weight of silicon. The steel sheet to be treated by the method of the invention may be a rimmed steel sheet containing less than 0.002% by weight of nitrogen. The restriction for the steel composition is because such steel needs the suppression of the nitrogenization, and the process according to the present invention is particularly effective to the steel of such compositions.

The minimum amounts of each of the aforesaid elements to be added in the steel must be selected so as to ensure satisfactory suppression of the nitrogenization, based on the test results as shown in FIG. 6. More particularly, the minimum amount of any one of the elements to reduce the nitrogenization must be restricted to the value by which nitrogen pick-up becomes one half of it of the non-treated steel. The upper limit of the amount of the elements to be added in the steel is selected so as to prevent any deterioration of the mechanical and physical properties of the final steel sheet product and to keep the process economically feasible. In fact, the adddition of any one of the elements in excess of 0.2% by weight tends to make the process too costly without improving the suppression of the nitrogenization any further.

Thus, the element or elements to be added in the steel according to the present invention is selected from the group consisting of 0.002 to 0.2% of tellurium, selenium, bismuth, and antimony and 0.01 to 0.2% of lead, tin, and arsenic. Incidentally, the content of arsenic in regular steel is less than 0.005%, and the contents of the other elements in commercial steel is less than 0.001%.

The element or elements may be added to the steel at a step in the course of making the steel, for instance in a furnace, ladle, or ingot case.

The steels to which at least one of the aforesaid elements is added are, for instance, cold-rolled aluminum killed steel sheet, cold-rolled mild steel sheet containing one or more nitride-former elements, e.g., titanium, silicon, boron, niobium, vanadium, or zirconium, cold-rolled silicon steel sheet, and cold-rolled low-nitrogen rimmed steel sheet. The conventional process, of course, includes steps of making molten steel, casting ingot, forming slab by rolling the ingot or by continuously casting the melt, hot-rolling the slab into hot-coil or sheet, pickling, cold-rolling the steel sheet and annealing the cold-rolled steel sheet either immediately after the cold-rolling or after degreasing thee cold-rolled steel sheet. The annealing of the cold-rolled steel sheet according to the present invention can be performed in vacuo or in conventional atmospheres, such as the HNX gas, DX gas, AX gas, and nitrogen gas.

The addition of one or more of the elements will now be described in further detail by referring to examples.

EXAMPLE 7

Commercial aluminum killed steel was melted in a converter, and an ingot of specimen A was made without adding any element therein, while another ingot specimen B was made by adding 0.015% of antimony. The ingot compositions of the specimens A and B were as shown in Table 12.

Table 12

| Specimen | Carbon (%) | Silicon (%) | Manganese (%) (%) | Phosphorus (%) | Sulfur (%) | Aluminum (%) | Antimony |
|---|---|---|---|---|---|---|---|
| | Chemical compositions of specimens | | | | | | |
| A | 0.042 | 0.009 | 0.59 | 0.007 | 0.013 | 0.061 | 0.001 |
| B | 0.041 | 0.009 | 0.38 | 0.007 | 0.012 | 0.060 | 0.015 |

The ingots of the specimens A and B were hot-rolled, pickled, cold-rolled, washed in a conventional fashion, and then annealed in a factory furnace of bell type for recrystallization. The atmosphere for the annealing was the HNX gas. The variations of the nitrogen contents of each sample before and after the annealing are shown in Table 13.

Table 13

| Specimen | Antimony content (%) | Nitrogen content (%) Before annealing | After annealing | Difference |
|---|---|---|---|---|
| | Suppression of nitrogenization by adding antimony in steel | | | |
| A | 0.001 | 0.0058 | 0.0223 | +0.0165 |
| B | 0.015 | 0.0059 | 0.0061 | +0.0002 |

With the aluminum killed steel sheet specimen A, in which antimony was not added, the nitrogen content increased by 0.0165% by the recrystallization annealing. On the other hand, in the case of the antimony-added specimen B, the variation of the nitrogen content by the recrystallization annealing is within the measuring error and negligible. Thus, the nitrogenization of the specimen B was practically completely eliminated.

EXAMPLE 8

Commercial aluminum killed steel was melted in a converter, and four ingots were made: namely, ingot C without any addition of elements: ingot D with additions of 0.003% of selenium and 0.02% of tin; ingot E with addition of 0.004% of selenium; and ingot F with addition of 0.02% of tin. The compositions of the ingots C to F are shown in Table 14.

Table 14

| Ingot | Carbon (%) | Silicon (%) | Manganese (%) | Phosphorus (%) | Sulfur (%) | Aluminum (%) | Nitrogen (%) | Selenium (%) | Tin (%) |
|---|---|---|---|---|---|---|---|---|---|
| | Chemical compositions of ingots | | | | | | | | |
| C | 0.038 | 0.008 | 0.32 | 0.007 | 0.016 | 0.042 | 0.0055 | — | — |
| D | 0.032 | 0.009 | 0.33 | 0.009 | 0.019 | 0.058 | 0.0060 | 0.003 | 0.02 |
| E | 0.035 | 0.009 | 0.30 | 0.008 | 0.017 | 0.046 | 0.0058 | 0.004 | — |
| F | 0.039 | 0.008 | 0.32 | 0.008 | 0.017 | 0.055 | 0.0059 | — | 0.02 |

The ingot of each specimen was hot-rolled, pickled, cold-rolled, washed, and then annealed for recrystallization in the HNX gas atmosphere in the tightly coiled condition. The nitrogen contents of the specimens after the annealing are shown in Table 15 together with the corresponding nitrogen contents before the annealing.

Table 15

| Specimen | Nitrogen content (%) Before annealing | After annealing | Difference |
|---|---|---|---|
| | Nitrogen contents in specimens before and after annealing | | |
| C | 0.0055 | 0.0203 | 0.0148 |
| D | 0.0060 | 0.0060 | — |
| E | 0.0058 | 0.0090 | 0.0032 |

Table 15-continued

| Specimen | Nitrogen contents in specimens before and after annealing — Nitrogen content (%) Before annealing | After annealing | Difference |
|---|---|---|---|
| F | 0.0059 | 0.0158 | 0.0099 |

The specimen D, in which selenium and tin were added, was completely free from the nitrogenization during the recrystallization annealing. The specimens E and F, each being provided with one element alone, exhibited a great reduction of the nitrogenization, as compared with that of non-treated specimen C. Thus, the effect of suppressing the nitrogenization by adding the aforesaid element or elements was clearly proved.

EXAMPLE 9

Commercial low-nitrogen rimmed steel was melted in a converter, and two ingots were made: namely, ingot G without any addition, and ingot H in which 0.01% of antimony was added. The ingot compositions are shown in Table 16.

Table 16

| Ingot | Chemical compositions of ingots — Carbon (%) | Manganese (%) | Phosphorus (%) | Sulfur (%) | Nitrogen (%) | Antimony (%) |
|---|---|---|---|---|---|---|
| G | 0.043 | 0.32 | 0.008 | 0.015 | 0.0010 | less than 0.001 |
| H | 0.042 | 0.32 | 0.008 | 0.015 | 0.0012 | 0.010 |

The ingots were hot-rolled, pickled, cold-rolled, washed, and all the specimens were simultaneously annealed for recrystallization in a bell type furnace with the HNX gas atmosphere in the tightly coiled condition. The nitrogen contents of the specimens after the annealing are shown in Table 17, together with the corresponding nitrogen contents before the annealing.

Table 17

| Specimen | Nitrogen contents in specimens before and after annealing — Nitrogen content (%) Before annealing | After annealing | Difference |
|---|---|---|---|
| G | 0.0010 | 0.0020 | 0.0010 |
| H | 0.0012 | 0.0012 | — |

As shown in Table 17, the nitrogen content of the specimen G was reduced to a very low level in the course of making the steel, but it increased to 0.0020% after the annealing so as to make the effort in the steel making step meaningless. On the other hand, the addition of 0.01% of antimony, as shown in the specimen H, completely eliminated the nitrogenization, during the recrystallization annealing.

What is claimed is:

1. A method for the suppression of graphite carbon formation on the surface of a cold-rolled, low carbon steel sheet due to carbon separation from the interior of the steel and for the suppression of nitrogenization of said steel sheet during annealing for recrystallization of said steel sheet, comprising coating the surface of said steel sheet before annealing with a mixture containing at least one compound in a concentration of 0.00001 to 0.001 mol/1, said at least one compound containing one or more of the elements selected from the group consisting of sulfur, aluminum, antimony, lead, bismuth, arsenic, tin, selenium and tellurium, said mixture being coated on said steel sheet electrolytically by passing said steel sheet through an electrolytic bath containing said mixture, said bath having a charge density of 1 to 20 coulombs/$dm^2$.

2. The method of claim 1 in which said cold-rolled steel sheet is electrolytically degreased at the same time as said electrolytic coating.

3. The method of claim 1 in which said cold-rolled steel sheet is degreased before said electrolytic coating.

4. The method of claim 1 wherein the sulfur-containing compound is a member selected from the group consisting of $K_2S$, $Na_2S_2O_3$, $K_2S_2O_3$, $Na_2S$, $FeSO_4$, $KHSO_4$, $NaHSO_3$, $S_2Cl_2$, $H_2SO_4$, $Al_2(SO_4)_3$, $K_2SO_4$, $FeSO4.(NH_4)_2SO_4$, $CrSO_4$, $K_2S_2O_7$, $K_2S_2O_8$, $Na_2S_2O_7$, $Na_2S_2O_8$, $Na_2SO_3$, $(NH_4)_2SO_4$, $NH_4HSO_3$, $(NH_4)_2S_2O_8$, $NH_4OSO_2NH_2$, $Na_2SO_4$, $ZnSO_4$, and $Ti(SO)_4)_2$.

5. The method of claim 1 wherein the aluminum-containing compound is a member selected from the group consisting of $Al_2(SO_4)_3$, $NaAlO_2$, $AlCl_3$, and $Al(NO_3)_3$.

6. The method of claim 1 wherein the antimony-containing compound is a member selected from the group consisting of $SbCl_3$, $SbBr_3$, SbOCl, $Sb_2(SO_4)_3$, and $Sb_2O_3$.

7. The method of claim 1 wherein the lead-containing compound is a member selected from the group consisting of $PbCl_2$, $Pb_2O(OH)_2$, $Pb(NO_3)_2$, and $Pb(CH_3COO)_2$.

8. The method of claim 1 wherein the bismuth-containing compound is a member selected from the group consisting of $NaBiO_3$, $BiCl_3$, $Bi_2(SO_4)_3$, and $Bi(NO_3)_3$.

9. The method of claim 1 wherein the arsenic-containing compound is a member selected from the group consisting of $As_2S_3$, $NaAsO_2$, $N_3AsO_4$, $KH_2AsO_4$, $Na_2HAsO_3$, $(NH_4)_3AsO_4$, $AsCl_3$, $As_2O_3$, and $K_2AsO_3$.

10. The method of claim 1 wherrein the tin-containing compound is a member selected from the group consisting of $SnCl_2$, $Sn(NO_3)_4$, and $SnI_2$.

11. The method of claim 1 whrein the selenium-containing compound is a member selected from the group consisting of $H_2SeO_3$, $Se_2Cl_2$, $SeOCl_2$, $SeS_2$, $H_2SeO_4$, $SeO_2$, $K_2Se$, $Na_2Se$, $K_2SeO_3$, $K_2SeO_4$, $Na_2SeO_3$, and $Na_2SeO_4$.

12. The method of claim 1 wherein the tellurium-containing compound is a member selected from the group consisting of $H_2TeO_4$, $K_2TeO_3$, $K_2TeO_4$, $Na_2TeO_3$, $Na_2TeO_4$, and $TeCl_4$.

13. The method of claim 1 wherein the the cold-rolled steel sheet is employed as the anode.

14. The method of claim 1 wherein the cold-rolled steel sheet is employed as the cathode.

15. The method of claim 1 wherein the cold-rolled steel sheet is employed alternately as the anode and as the cathode.

* * * * *